US010713902B2

(12) United States Patent
Lamb

(10) Patent No.: US 10,713,902 B2
(45) Date of Patent: Jul. 14, 2020

(54) GAMING SYSTEMS, DEVICES AND METHODS FOR APPLYING PAYOUT ENHANCEMENTS IN INTERVALS

(71) Applicant: KING SHOW GAMES, INC., Minnetonka, MN (US)

(72) Inventor: Jacob Lamb, Maple Grove, MN (US)

( * ) Notice: Subject to any disclaimer, the term of this patent is extended or adjusted under 35 U.S.C. 154(b) by 0 days.

(21) Appl. No.: 16/178,020

(22) Filed: Nov. 1, 2018

(65) Prior Publication Data

US 2019/0139371 A1 May 9, 2019

Related U.S. Application Data

(60) Provisional application No. 62/581,970, filed on Nov. 6, 2017.

(51) Int. Cl.
*G07F 17/34* (2006.01)
*G07F 17/32* (2006.01)

(52) U.S. Cl.
CPC ..... *G07F 17/34* (2013.01); *G07F 17/3213* (2013.01); *G07F 17/3244* (2013.01)

(58) Field of Classification Search
None
See application file for complete search history.

(56) References Cited

U.S. PATENT DOCUMENTS

| | | | | |
|---|---|---|---|---|
| 10,332,335 | B2 * | 6/2019 | Halvorson | G07F 17/3213 |
| 2004/0266512 | A1 | 12/2004 | Kaminkow | |
| 2011/0034234 | A1 * | 2/2011 | Berman | G07F 17/34 463/20 |
| 2013/0178274 | A1 | 7/2013 | Lucchesi et al. | |
| 2014/0080586 | A1 | 3/2014 | Walker et al. | |
| 2014/0335931 | A1 * | 11/2014 | Kemper | G07F 17/34 463/20 |
| 2016/0086429 | A1 * | 3/2016 | Inamura | G07F 17/326 463/20 |

* cited by examiner

*Primary Examiner* — Ronald Laneau

(57) ABSTRACT

Systems, apparatuses and methods for enhancing gaming payouts based on payout occurrence frequency. In one embodiment, symbols are associated with a counter value or other tracking measure. The counter value changes in connection with certain events, such as when the respective symbol is involved in a game result that wins and/or provides a payout. When the counter value for a particular symbol or group of symbols reaches a threshold, that particular payout is made subject to a payout modifier.

18 Claims, 13 Drawing Sheets

300A

| 302 SYMBOL | 304 COUNTER |
|---|---|
| M1 | 4 |
| M2 | 1 |
| M3 | 7 |
| M4 | 7 |
| F5 | 2 |
| F6 | 3 |
| F7 | 8 |
| F8 | 9 |
| F9 | 5 |
| FA | 3 |

314 → M2; 318 ← 1
306 → M4; 310 ← 7
308 → F6; 312 ← 3
316 → F8; 320 ← 9

300B

| 302 SYMBOL | 304 COUNTER |
|---|---|
| M1 | 4 |
| M2 | 1 |
| M3 | 7 |
| M4 | 6 |
| F5 | 2 |
| F6 | 2 |
| F7 | 8 |
| F8 | 9 |
| F9 | 5 |
| FA | 3 |

314 → M2; 318 ← 1
306 → M4; 310 ← 6
308 → F6; 312 ← 2
316 → F8; 320 ← 9

300C

| 302 SYMBOL | 304 COUNTER |
|---|---|
| M1 | 4 |
| M2 | 9 |
| M3 | 7 |
| M4 | 6 |
| F5 | 2 |
| F6 | 2 |
| F7 | 8 |
| F8 | 8 |
| F9 | 5 |
| FA | 3 |

314 → M2; 318 ← 9
306 → M4; 310 ← 6
308 → F6; 312 ← 2
316 → F8; 320 ← 8

FIG. 3

| HAND (1224) | COUNTER (1222) |
|---|---|
| ROYAL FLUSH | 4 |
| STRAIGHT FLUSH | 1 |
| 4-OF-A-KIND | 5 |
| FULL HOUSE | 7 |
| FLUSH (1224A) | 2 |
| STRAIGHT | 3 |
| 3-OF-A-KIND | 2 |
| TWO PAIRS | 4 |
| PAIR | 5 |

1230

| HAND CHARACTERISTIC (1234) | COUNTER (1232) |
|---|---|
| FLUSH DIAMONDS | 4 |
| FLUSH CLUBS (1234A) | 1 |
| FLUSH HEARTS | 5 |
| FLUSH SPADES | 7 |
| TWO PAIR WITH FACECARDS | 2 |
| ⋮ | ⋮ |
| PAIR WITH FACECARDS | 5 |

GAMING SYSTEMS, DEVICES AND METHODS FOR APPLYING PAYOUT ENHANCEMENTS IN INTERVALS

FIELD

This disclosure relates generally to games, and more particularly to systems, apparatuses and methods for providing payout modifiers in irregular intervals based on quantity of payout occurrence.

BACKGROUND

Casino games such as poker, slots, and craps have long been enjoyed as a means of entertainment. Some of these games originated using traditional elements such as playing cards or dice. More recently, gaming devices have been developed to simulate and/or further enhance these games while remaining entertaining. The popularity of casino gambling with wagering continues to increase, as does recreational gambling such as non-wagering computer game gambling. Part of this popularity is due to the increased development of new types of games that are implemented, at least in part, on gaming devices.

One reason that casino games are widely developed for gaming devices is that a wide variety of games can be implemented on gaming devices, thereby providing an array of choices for players looking to gamble. For example, the graphics and sounds included in such games can be modified to reflect popular subjects, such as movies and television shows. Game play rules and types of games can also vary greatly providing many different styles of gambling. Additionally, gaming devices require minimal supervision to operate on a casino floor, or in other gambling environments. That is, as compared to traditional casino games that require a dealer, banker, stickman, pit managers, etc., gaming devices need much less employee attention to operate.

With the ability to provide new content, players have come to expect the availability of an ever wider selection of new games when visiting casinos and other gaming venues. Playing new games adds to the excitement of "gaming." As is well known in the art and as used herein, the term "gaming" and "gaining devices" generally involves some form of wagering, and that players make wagers of value, whether actual currency or something else of value, e.g., token or credit. Wagering-type games usually provide rewards based on random chance as opposed to skill, although some skill may be an element in some types of games. Since random chance is a significant component of these games, they are sometimes referred to as "games of chance."

The present disclosure describes systems, apparatuses and methods that facilitate new and interesting gaming experiences, and provide advantages over the prior art.

SUMMARY

The present disclosure is directed to systems, apparatuses, computer-readable media, and/or methods that are configured to provide payout modifiers to enhance game event payouts in irregular intervals based on quantity of payout occurrence.

In accordance with one embodiment, symbols are associated with a counter value. The counter value changes in connection with desired events, such as changing the counter value when the respective symbol is involved in a game result that provides a payout. When the counter value for a particular symbol (or group of symbols) reaches a threshold value, such as counting down from a fixed or randomly-set value, that particular payout is made subject to a payout modifier, such as being multiplied by some awarded multiplier value.

In accordance with another embodiment, a gaming apparatus is provided that utilizes symbols to identify winning results. The gaming apparatus includes a symbol selection module configured to select symbols for a slot game event. A display presents the selected symbols in a play area of the slot game event, and presents correlations of designated selected symbols and respective tracking values. A tracking module is coupled to the symbol selection module to maintain the tracking values for each of the designated symbols, and to advance each of the tracking values towards a threshold value in response to its respective one of the designated symbols being involved in a winning symbol combination. A monitor module is coupled to the tracking module to determine that any of the tracking values reach the threshold value. An award enhancement module is coupled to the monitor module to award a payout enhancement for the winning symbol combinations associated with the designated symbols involved in the winning symbol combinations, in response to the tracking module determining that any of the tracking values reached the threshold value. An award identification module awards payouts from the winning symbol combinations, and enhances the identified payouts with the payout enhancement for those winning symbol combinations that were awarded the payout enhancement.

In a more particular embodiment of such a gaming apparatus, the tracking values are implemented as counter values each having an initial count, and the threshold value is implemented as a counter threshold value. In such an embodiment, the tracking module is implemented as a counter module configured to reset the counter values to the initial count in response to the determining that any of the respective counter values reached the counter threshold value.

In another embodiment of such a gaining apparatus, the tracking values include counter values each beginning at a respective initial count, the threshold values each include counter threshold values corresponding to respective count values in which the payout enhancement for the respective designated selected symbols will be awarded. In such an embodiment, the tracking module may include a counter module configured to maintain a current count value for each of the designated selected symbols, and to advance the counter towards the counter threshold values. In one embodiment, the monitor module may be implemented as one or more comparator modules configured to determine that any of the counter values have reached the respective counter threshold values. In a more particular embodiment, the award enhancement module may be coupled to the counter module and configured to award the payout enhancement for the winning symbol combinations associated with the designated symbols involved in the winning symbol combinations, in response to the comparator modules determining that any of the counter values reached the respective counter threshold value. In an alternative embodiment, the initial count may be common to each of the designated symbols, and the counter threshold values are common to each of the designated symbols.

In another embodiment of such a gaming apparatus, the payout enhancement may be represented by a multiplier value. In such an embodiment, the award enhancement module awards the multiplier value for the winning symbol combinations associated with the designated symbols involved in the winning symbol combinations, in response to the tracking module determining that any of the tracking values reached the threshold value. Further, in such an embodiment, the award identification module enhances the identified payouts with the multiplier value for those winning symbol combinations that were awarded the payout enhancement, by multiplying the respective identified payouts and the multiplier value. In a more particular embodiment, the multiplier value is the same for each of the winning symbol combinations, where in an alternative representative embodiment, multiple multiplier values are provided and respectively associated with different winning symbol combinations.

In still another embodiment of such a gaming apparatus, the tracking module is configured to advance each of the tracking values towards a threshold value in response to its respective one of the designated symbols being involved in a winning symbol combination in a particular quantity.

In accordance with another embodiment, a slot game apparatus is provided that includes a display that presents symbols in symbol locations forming a symbol array, and presents correlations of specified symbols and respective counter values. A user interface includes user inputs to allow players to initiate and participate in slot game events presented via the symbol array. A wager input device may be provided to identify and validate player assets, and to permit the player to play the slot game event when the player assets are provided. A processor is configured to randomly select from the game's symbols for positioning in the symbol locations of the symbol array in response to initiating of a slot game event. The processor is configured to advance the counter values associated with each of the specified symbols that has correlating counter values, if the respective specified symbol is involved in a result of the slot game event involving a payout. The processor is further configured to monitor for any of the counter values reaching a threshold. For any of the counter values reaching the threshold, the processor is configured to award a respective payout modifier, and to increase the payout of the slot game events whose counter values have reached the threshold by mathematically applying its respective payout modifier thereto.

In another embodiment, the processor of such slot game device may be configured to cause the display to present updates to the correlations of specified symbols and their respective counter values, as additional specified symbols are involved in results of the slot game events involving payouts.

In yet another embodiment, the payout modifier is a multiplier value determined in advance of the initiation of the slot game event and made known to the player.

In one embodiment, the processor is configured to advance the counter values a single advance for each of the specified symbols involved in the slot game event result involving a payout, regardless of how many results involving the payouts originated from the same specified symbol. In an alternative representative embodiment, the processor is configured to advance the counter values once for each of the quantity of results involving the payouts originating from the same specified symbol.

In another embodiment of such a slot game apparatus, the processor is configured to advance the counter values associated with each of the specified symbols if the respective specified symbol is involved in a payout, and if the result involving the respective specified symbol has a predetermined minimum number of consecutive ones of the specified symbols. In another representative alternative embodiment, the processor is configured to advance the counter values associated with each of the specified symbols if the respective specified symbol is involved in the result involving a payout, and if an indicator is presented in connection with the slot game event that enables the advancement.

In one embodiment of the slot game apparatus, the display further presents separate correlations of the respective counter values for each of the specified symbols based on their consecutive symbol length.

In accordance with another embodiment, a method is provided for enhancing payouts in gaining activities. The method includes respectively associating counters with various symbols each capable of providing a payout when a qualifying combination of the like symbols occurs. Each counter is adjusted towards a respective threshold when its respective symbol has formed the qualifying combination and provided a payout. Each of the counters may be monitored, and a payout modifier is provided for any of the counters reaching its respective threshold. Each payout that is provided may be enhanced in response to the respective symbol having formed the qualifying combination and its respective counter has reached its respective threshold. In one embodiment, the enhancement of each payout is accomplished by applying the payout modifier to the payout. In a more particular embodiment, the method further includes resetting the any of the counters reaching its respective threshold in response to enhancing each respective payout.

This summary serves as an abbreviated, selective introduction of a representative subset of various concepts and embodiments that are further described or taught to those skilled in the art in the Specification herein. This summary is not intended to refer to all embodiments, scopes, or breadths of claims otherwise supported by the Specification, nor to identify essential features of the claimed subject matter, nor to limit the scope of the claimed subject matter.

BRIEF DESCRIPTION OF THE DRAWINGS

FIG. 3 depicts various stages of a symbol-based gaming activity as events occur to advance a tracker towards a threshold where a player asset may be awarded.

DETAILED DESCRIPTION

Figure 1:
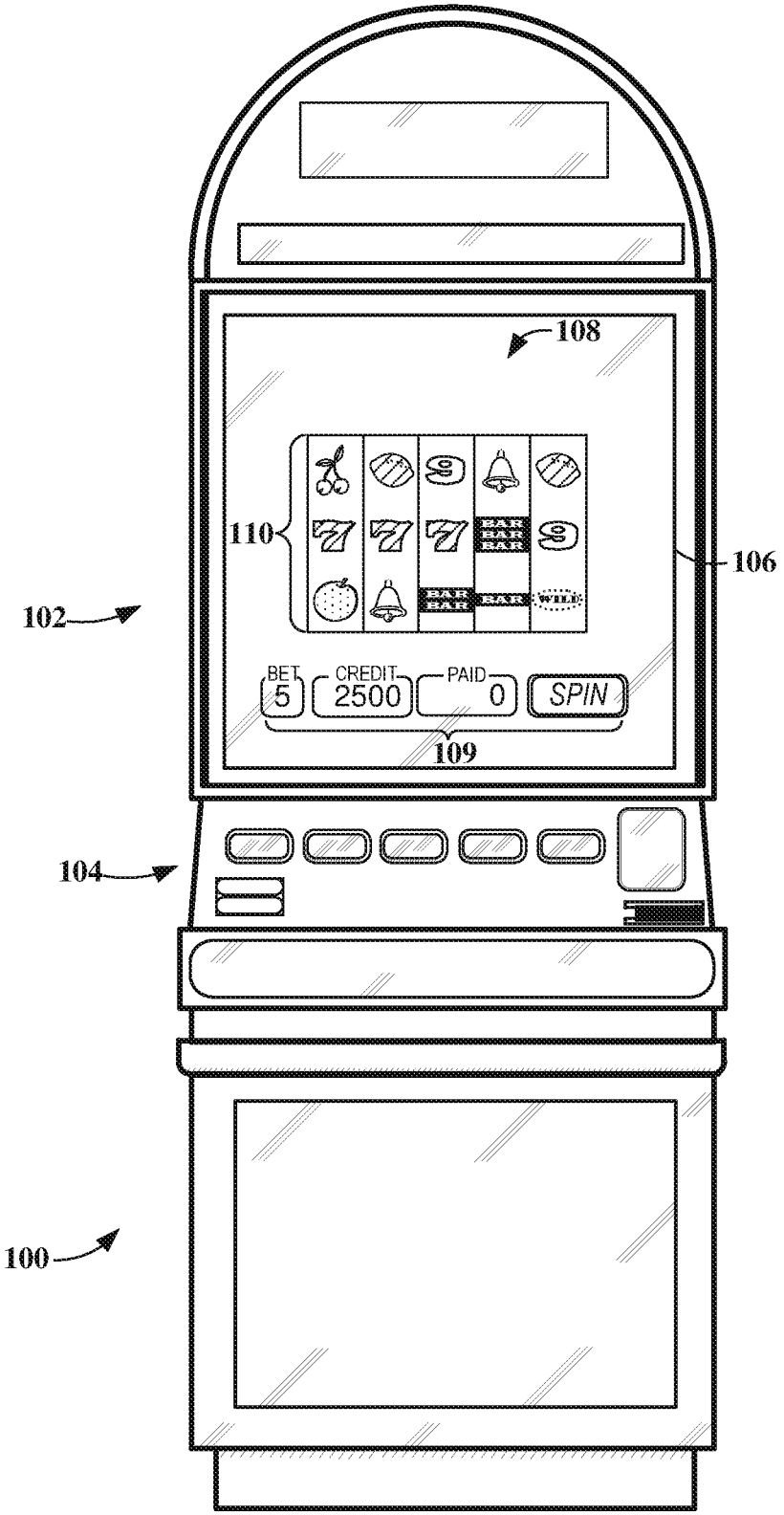
FIG. 1 is a diagram of a representative gaming machine capable of facilitating player use and interaction with games and features in accordance with the invention and representative embodiments described herein.

In the following description of various exemplary embodiments, reference is made to the accompanying drawings which form a part hereof, and in which is shown by way of illustration representative embodiments in which the features described herein may be practiced. It is to be understood that other embodiments may be utilized, as structural and operational changes may be made without departing from the scope of the disclosure.

In the description that follows, the terms "reels," "cards," "decks," and similar mechanically descriptive language may be used to describe various apparatus presentation features, as well as various actions occurring to those objects (e.g., "spin," "draw," "hold," "bet"). Although the present disclosure may be applicable to manual, mechanical, and/or computerized embodiments, as well as any combination therebetween, the use of mechanically descriptive terms is not meant to be only applicable to mechanical embodiments. Those skilled in the art will understand that, for purposes of providing gaming experiences to players, mechanical elements such as cards, reels, and the like may be simulated on a display in order to provide a familiar and satisfying experience that emulates the behavior of mechanical objects, as well as emulating actions that occur in the non-computerized games (e.g., spinning, holding, drawing, betting). Further, the computerized version may provide the look of mechanical equivalents but may be generally randomized in a different way. Thus, the terms "cards," "decks," "reels," "hands," etc., are intended to describe both physical objects and emulation or simulations of those objects and their behaviors using electronic apparatuses.

In various embodiments, the gaming displays are described in conjunction with the use of data in the form of "symbols." In the context of this disclosure, a "symbol" may generally refer at least to a collection of one or more arbitrary indicia or signs that have some conventional or defined significance. In particular, the symbol may represent values that can at least be used to determine whether to award a payout. A symbol may include numbers, letters, shapes, pictures, textures, colors, sounds, etc., and any combination therebetween. A play state, such as a win, can be determined by comparing the symbol with one or more other symbols. Such comparisons can be performed, for example, via software by mapping numbers (or other data structures such as character strings) to the symbols and performing the comparisons on the numbers/data structures. Other conventions associated with known games (e.g., the numerical value/ordering of face cards and aces in card games) may also be programmatically analyzed to determine winning combinations.

Generally, systems, apparatuses and methods are described for providing payout modifiers to enhance game event payouts in irregular intervals based on quantity of payout occurrence. The systems, apparatuses and methods described herein may be implemented as a single game, or part of a multi-part game. For example, the game features described herein may be implemented in primary gaming activities, bonus games, side bet games or other secondary games associated with a primary gaming activity. The game features may be implemented in stand-alone games, multi-player games, etc. Further, the disclosure may be applied to games of chance, and descriptions provided in the context of any representative game (e.g. slot game) is provided for purposes of facilitating an understanding of the features described herein. However, the principles described herein are equally applicable to any game of chance where an outcome(s) is determined for use in the player's gaming activity.

Embodiments of the present concept include providing gaming devices (also referred to as gaming apparatuses or gaming machines), gaming systems, and methods of operating these devices or systems to provide game play that involves providing payout modifiers to enhance game event payouts in irregular intervals based on quantity of payout occurrence. In one embodiment, a subset or all symbols used in a gaining activity are assigned a counter in groups or individually, and when respective counters reach predetermined values or otherwise count up or down for a particular number of defined events (e.g., wins in the gaming event involving the respective symbol(s)), a payout modifier, such as a multiplier, is awarded for use in a particular payout (e.g., a winning payout(s) involving the respective symbol(s)).

Numerous variations are possible in view of these and other embodiments of the inventive concept. Representative embodiments and variations are described herein, with some embodiments described with reference to the drawings. However, many other embodiments and variations exist that are covered by the principles and scope of this concept. For example, although some of the embodiments discussed below involve reel-based slot machine examples of this concept, other embodiments include application of these inventive techniques in other types of slot games, poker games, roulette, bingo, or other games of chance. Some of these other types of embodiments will be discussed below as variations to the examples illustrated. However, many other types of games can implement similar techniques and fall within the scope of this disclosed concept.

Referring to the example gaming apparatus 100 shown in FIG. 1, the representative gaming apparatus includes at least a display area(s) 102 (also referred to as a gaming display), and a player interface areas) 104, although some or all of the interactive mechanisms included in the user interface area 104 may be provided via other or additional means, such as graphical icons used with a touch screen in the display area 102 in some embodiments. The display area 102 may include one or more game displays 106 (also referred to as "displays" or "gaming displays") that may be included in physically separate displays or as portions of a common large display. Here, the representative game display 106 includes at least a primary game play portion 108 that displays game elements and symbols 110, and an operations portion 109 that can include meters, various game buttons and other input mechanisms, and/or other game information for a player of the gaming device 100.

The user interface 104 allows the user to control, engage in play of, and otherwise interact with the gaming machine 100. The particular user interface mechanisms included with user interface 104 may be dependent on the type of gaming device. For example, the user interface 104 may include one or more buttons, switches, joysticks, levers, pull-down handles, trackballs, voice-activated input, touchscreen input, tactile input, and/or any other user input system or mechanism that allows the user to play and interact with the particular gaming activity.

The user interface 104 may allow the user or player to enter coins, bills, or otherwise obtain credits through vouchers, tokens, credit cards, tickets, electronic money, etc. Various mechanisms for entering such vouchers, tokens, credit cards, coins, tickets, etc. are described below with reference to FIG. 2. For example, currency input mechanisms, card readers, credit card readers, smart card readers, punch card readers, radio frequency identifier (RFID) readers, and other mechanisms may be used to enter wagers. The user interface 104 may also include a mechanism to read and/or validate player information, such as player loyalty information to identify a user or player of the gaming device. This mechanism may be, for example, a card reader, biometric scanner, keypad, or other input device. It is through a user interface such as the user interface 104 that the player can initiate and engage in gaming activities. While the illustrated embodiment depicts various buttons for the user interface 104, it should be recognized that a wide variety of user interface options are available for use in connection with the present invention, including pressing buttons, touching a segment of a touch-screen, entering text, entering voice commands, or other known data entry methodology.

The game display 106 in the display area 102 may include one or more of an electronic display, a video display, a mechanical display, and fixed display information, such as pay table information associated with a glass/plastic panel(s) on the gaming machine 100 and/or graphical images. The symbols or other indicia associated with the play of the game may be presented on an electronic display device or on mechanical devices associated with a mechanical display. Generally, in some embodiments, the display 106 devotes the largest portion of viewable area to the primary gaming portion 108. The primary gaming portion 108 may provide visual feedback to the user for any selected game. The primary gaining portion 108 may render graphical objects such as cards, slot reels, dice, animated characters, and any other gaming visual known in the art. The primary gaming portion 108 may also inform players of the outcome of any particular event, including whether the event resulted in a win or loss.

In some example embodiments illustrated herein, the primary gaining portion 108 may display a grid (or equivalent arrangement) of game elements 110 or game element positions (also referred to herein as "reel stop positions"). As illustrated in the embodiment shown in FIG. 1, the grid includes three rows and five columns of game elements 110, which may form a game outcome(s) of a game play event from which prizes are determined. In some slot machine examples, each column may display a portion of a game reel. The game reels may include a combination of game symbols in a predefined order. In mechanical examples, the game reels may include physical reel strips where game symbols are shown in images fixed on the reel strips. Virtual reel strips may be mapped to these physical reel positions shown on the reel strips to expand the range or diversity of game outcomes. In video slot examples, reel strips may be encoded in a memory or database and virtual reels may be used for the game reels with images representing the data related to the reel strips. In other slot machine embodiments, each reel stop position on the grid may be associated with an independent reel strip. In yet other slot machine embodiments, reels and/or reel strips may not be used at all in determining the symbols shown in the game element positions of the grid. For example, a symbol may be randomly selected for each game element position, or the symbols may be determined in part by game events occurring during game play, such as displayed elements being replaced by new game elements or symbols. Numerous variations are possible for implementing slot-type game play.

The primary gaming portion 108 may include other features known in the art that facilitate gaming, such as status and control portion 109. As is generally known in the art, this portion 109 provides information about current bets, current wins, remaining credits, etc. associated with gaming activities of the grid of game elements 110. The control portion 109 may also provide touchscreen controls for facilitating game play. The grid of game elements 110 may also include touchscreen features, such as facilitating selection of individual symbols, or user controls over stopping or spinning reels. The game display 106 of the display area 102 may include other features that are not shown, such as pay tables, navigation controls, etc.

Figure 2:
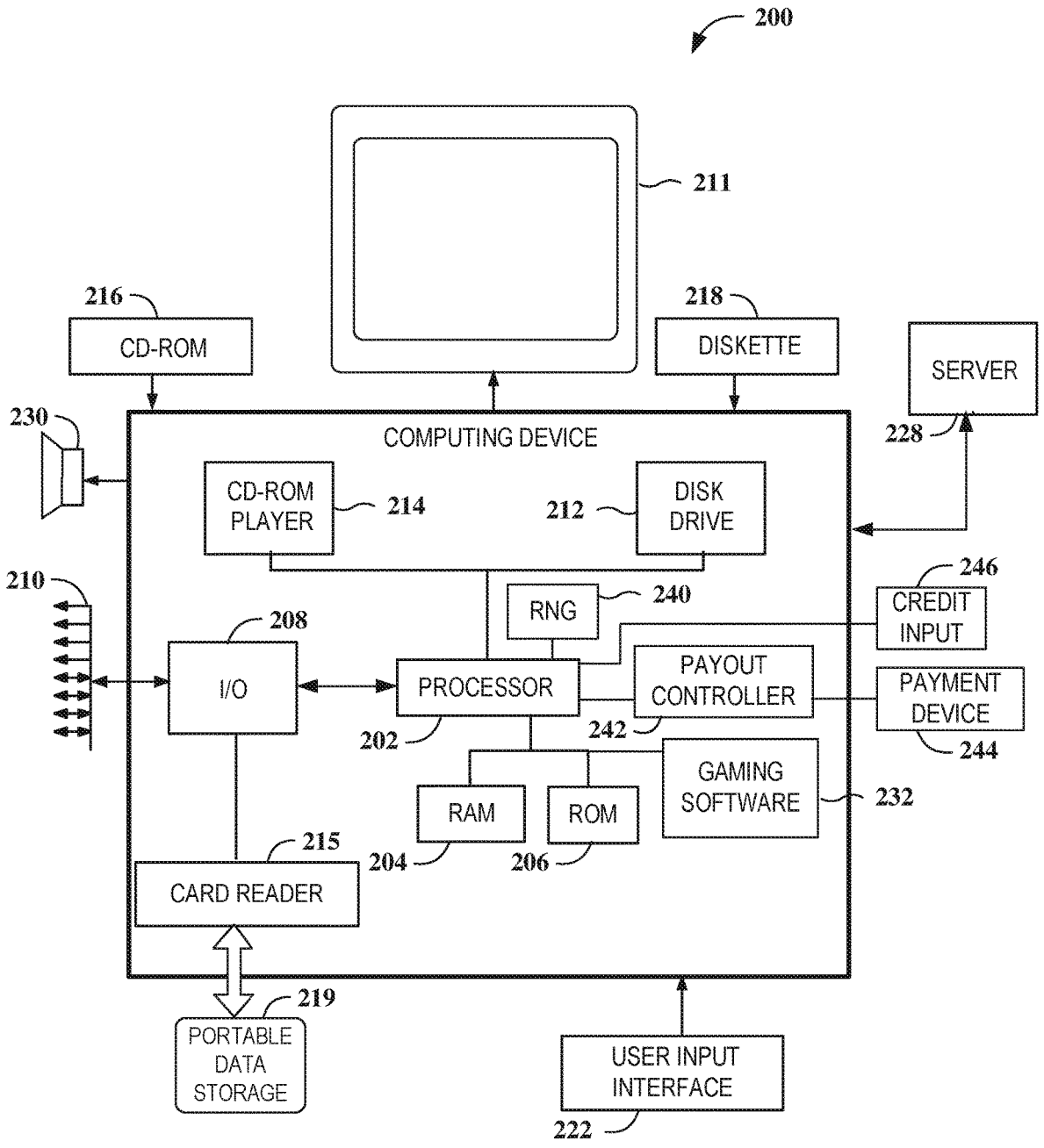
FIG. 2 is a block diagram illustrating a representative computing arrangement capable of implementing games and features in accordance with the invention and representative embodiments described herein.

Although FIG. 1 illustrates a particular implementation of some of the embodiments of this invention in a casino or electronic gaming machine ("EGM"), one or more devices may be programmed to play various embodiments of the invention. The concepts and embodiments described herein may be implemented, as shown in FIG. 1, as a casino gaming machine or other special purpose gaming kiosk as described herein, or may be implemented via computing systems operating under the direction of local gaming software, and/or remotely-provided software such as provided by an application service provider (ASP). Casino gaining machines may also utilize computing systems to control and manage the gaming activity, although these computing systems typically include specialized components and/or functionality to operate the particular elements of casino gaming machines. Additionally, computing systems operating over networks, such as the Internet, may also include specialized components and/or functionality to operate elements particular to these systems, such as random number generators. An example of a representative computing system capable of carrying out operations in accordance with the principles described herein is illustrated in FIG. 2.

Hardware, firmware, software or any combination thereof may be used to perform the various gaming functions, display presentations and operations described herein. The functional modules used in connection with the disclosure may reside in a gaming machine as described, or may alternatively reside on a stand-alone or networked computer. The representative computing structure 200 of FIG. 2 is an example of a computing structure that can be used in connection with such electronic gaming machines, computers, or other computer-implemented devices to carry out operations of the present invention. Although numerous components or elements are shown as part of this computing structure 200 in FIG. 2, additional or fewer components may be utilized in particular implementations of embodiments of the invention.

The example computing arrangement 200 suitable for performing the gaming functions described herein includes a processor, such as depicted by the representative central processing unit (CPU) 202, coupled to memory, such as random access memory (RAM) 204, and some variation of read-only memory (ROM) 206 or other persistent storage. The ROM 206 may also represent other types of storage media to store programs, such as programmable ROM (PROM), erasable PROM (EPROM or any technology capable of storing data). The processor 202 may communicate with other internal and external components through input/output (I/O) circuitry 208 and bussing 210, to communicate control signals, communication signals, and the like.

The computing arrangement 200 may also include one or more data storage devices, including hard and floppy disk drives 212, CD-ROM drives 214, card reader 215, and other hardware capable of reading and/or storing information such as DVD, etc. In one embodiment, software for carrying out the operations in accordance with the present invention may be stored and distributed on a CD-ROM 216, diskette 218, access card 219, or other form of computer readable media capable of portably storing information. These storage media may be inserted into, and read by, devices such as the CD-ROM drive 214, the disk drive 212, card reader 215, etc. The software may also be transmitted to the computing arrangement 200 via data signals, such as being downloaded electronically via a network, such as local area network (casino, property, or bank network) or a wide area network (e.g., the Internet). Further, as previously described, the software for carrying out the functions associated with the present invention may alternatively be stored in internal memory/storage of the computing device 200, such as in the ROM 206.

The computing arrangement 200 is coupled to one or more displays 211, which represent a manner in which the gaming activities may be presented. The display 211 represents the "presentation" of the game information in accordance with the disclosure, and may be a mechanical display showing physical spinning reels, a video display, such as liquid crystal displays, plasma displays, cathode ray tubes (CRT), digital light processing (DLP) displays, liquid crystal on silicon (LCOS) displays, etc., or any type of known display or presentation screen.

Where the computing device 200 represents a stand-alone or networked computer, the display 211 may represent a standard computer terminal or display capable of displaying multiple windows, frames, etc. Where the computing device 200 represents a mobile electronic device, the display 211 may represent the video display of the mobile electronic device. Where the computing device 200 is embedded within an electronic gaming machine, the display 211 corresponds to the display screen of the gaming machine/kiosk.

A user input interface 222 such as a mouse, keyboard/keypad, microphone, touch pad, trackball, joystick, touch screen, voice-recognition system, card reader, biometric scanner, RFID detector, etc. may be provided. The user input interface 222 may be used to input commands in the computing arrangement 200, such as placing wagers or initiating gaming events on the computing arrangement 200, inputting currency or other payment information to establish a credit amount or wager amount, inputting data to identify a player for a player loyalty system, etc. The display 211 may also act as a user input device, e.g., where the display 211 is a touchscreen device. In embodiments, where the computing device 200 is implemented in a personal computer, tablet, smart phone, or other consumer electronic device, the user interface and display may be the available input/output mechanisms related to those devices.

Chance-based gaming systems such as slot machines, in which the present invention is applicable, are governed by random numbers and processors, as facilitated by a random number generator (RNG) or other random generator. The fixed and dynamic symbols generated as part of a gaming activity may be produced using one or more RNGs. RNGs may be implemented using hardware, software operable in connection with the processor 202, or some combination of hardware and software. The principles described herein are operable using any known RNG, and may be integrally programmed as part of the processor 202 operation, or alternatively may be a separate RNG controller 240 that may be associated with the computing arrangement 200 or otherwise accessible such as via a network. The RNGs are often protected by one or more security measures to prevent tampering, such as by using secured circuitry, locks on the physical game cabinet, and/or remote circuitry that transmits data to the gaming device. The computing arrangement 200 may be connected to other computing devices or gaming machines, such as via a network. The computing arrangement 200 may be connected to a network server(s) 228 in an intranet or local network configuration. The computer may further be part, of a larger network configuration as in a global area network (GAN) such as the Internet. In such a case, the computer may have access to one or more web servers via the Internet. In other arrangements, the computing arrangement 200 may be configured as an Internet server and software for carrying out the operations in accordance with the present invention may interact with the player via one or more networks. The computing arrangement 200 may also be operable over a social network or other network environment that may or may not regulate the wagering and/or gaming activity associated with gaming events played on the computing arrangement.

Other components directed to gaming machine implementations include manners of gaining participant payment, and gaming machine payout. For example, a gaming machine including the computing arrangement 200 may also include a payout controller 242 to receive a signal from the processor 202 or other processor(s) indicating a payout is to made to a player and controlling a payout device 244 to facilitate payment of the payout to the player. In some embodiments, the payout controller 242 may independently determine the amount of payout to be provided to the participant or player. In other embodiments, the payout controller 242 may be integrally implemented with the processor 202. The payout controller 242 may be a hopper controller, a print driver, credit-transmitting device, bill-dispensing controller, accounting software, or other controller device configured to verify and/or facilitate payment to a player.

A payout or payment device 244 may also be provided in gaming machine embodiments, where the payment device 244 serves as the mechanism providing the payout to the player or participant. In some embodiments, the payment device 244 may be a hopper, where the hopper serves as the mechanism holding the coins/tokens of the machine, and/or distributing the coins/tokens to the player in response to a signal from the payout controller 242. In other embodiments, the payout device 244 may be a printer mechanism structured to print credit-based tickets that may be redeemed by the player for cash, credit, or other casino value-based currency or asset. In yet other embodiments, the payout device 244 may send a signal via the network server 228 or other device to electronically provide a credit amount to an account associated with the player, such as a credit card account or player loyalty account. The computing arrangement 200 may also include accounting data stored in one of the memory devices 204, 206. This accounting data may be transmitted to a casino accounting network or other network to manage accounting statistics for the computing arrangement or to provide verification data for the currency or currency-based tickets distributed by the payout device, such as providing the data associated with the bar codes printed on the currency-based tickets so they are identifiable as valid tickets for a particular amount when the player redeems them or inserts them in another gaining device.

The wager input module or device 246 represents any mechanism for accepting coins, tokens, coupons, hills, electronic fund transfer (EFT), tickets, credit cards, smart cards, membership/loyalty cards, or any other player assets, for which a participant inputs a wager amount. The wager input device 246 may include magnetic strip readers, bar code scanners, light sensors, or other detection devices to identify and validate physical currency, currency-based tickets, cards with magnetized-strips, or other medium inputted into the wager input device. When a particular medium is received in the wager input device 246, a signal may be generated to establish or increase an available credit amount or balance stored in the internal memory/storage of the computing device 200, such as in the RAM 204. Thereafter, specific wagers placed on games may reduce the available credit amount, while awards won may increase the available credit amount. It will be appreciated that the primary gaining software 232 may be able to control payouts via the payment device 244 and payout controller 242 for independently determined payout events.

Among other functions, the computing arrangement 200 provides an interactive experience to players via an input interface 222 and output devices, such as the display 211, speaker 230, etc. These experiences are generally controlled by gaming software 232 that controls a primary gaming activity of the computing arrangement 200. The gaming software 232 may be temporarily loaded into RAM 204, and may be stored locally using any combination of ROM 206, drives 212, media player 214, or other computer-readable storage media known in the art. The primary gaining software 232 may also be accessed remotely, such as via the server 228 or the Internet.

The primary gaming software 232 in the computing arrangement 200 may be an application software module. According to embodiments of the present invention, this software 232 provides a slot game or similar game of chance as described herein. For example, the software 232 may present, by way of the display 211, representations of symbols to map or otherwise display as part of a slot based game having reels. However, in other embodiments, the principles of this concept may be applied to poker games or other types of games of chance. One or more aligned positions of these game elements may be evaluated to determine awards based on a pay table. The software 232 may include instructions to provide other functionality as known in the art or as described and shown herein.

The systems, apparatuses and methods operable via these and analogous computing and gaming devices can support gaming features as described herein. In one embodiment, gaming devices and methods are provided that facilitate play of a game, such as a wagering game where real or imaginary monetary player assets are provided in the chance of receiving real or imaginary monetary payouts. In some embodiments, payout modifiers are provided to enhance game event payouts in randomly irregular intervals based on quantity of payout occurrence. In one embodiment, each symbol, or in other embodiments groups of symbols, are associated with a count, and when the count reaches some defined (or in other embodiments random) threshold, a payout modifier or other payout enhancer is made available for the symbol or group of symbols whose counter reached its threshold. For example, a countdown timer may be applied to one, some, or all of the symbols in a slot game, whether applied individually to symbols or applied to a plurality or all of the symbols as a group. Further with this example, on each gaming event (e.g., reel spin event) that the symbol is involved in a payout (e.g., is part of a symbol combination on a payline or in any other defined configuration where a payout result is defined to be provided), the countdown timer decrements a predetermined amount (e.g., by one, in one embodiment), and when reaching a predetermined level (e.g., zero, in one embodiment), the payout occurring with that symbol is assigned a multiplier (e.g., 10× multiplier or any other desired modifier capable of enhancing a gaming payout).

Many embodiments may be described in terms of a slot game, where symbols are matched on paylines to determine payout awards. However, the principles described herein are equally applicable to other games of chance, as described herein and as will be readily apparent to those skilled in the art from the teachings herein.

In one embodiment, a bet is made to enable the features described herein. For example, a primary wager may be made to participate in a primary gaming event (e.g., a slot game reel spin event), and an additional wager may be placed to activate the features described herein. In other embodiments, a single wager is placed to participate in the primary gaming event, and any cost of participating in the features described herein are incorporated into the primary gaming event wager. However, as noted in one embodiment, an additional wager, such as a bonus bet, side bet, additional credit allocation, and/or any desired manner of applying player assets to the feature may be implemented. Further, while any award modification may be implemented in connection with the present disclosure, various embodiments set forth herein are described in connection with a multiplier, which modifies awards by increasing such awards by some factor.

In one representative embodiment, a bonus bet is placed which causes every $N^{th}$ win of a particular symbol(s) to be multiplied by a defined or randomly-assigned multiplier or other payout modifier. In one specific example, a bonus bet may be placed that causes every $9^{th}$ win of a particular symbol to be multiplied by ten (i.e. a 10× multiplier). In such an embodiment, every symbol in a paytable is assigned a countdown (or count up) counter. In other embodiments, groups of symbols may be assigned to a common countdown counter, such that when the counter reaches its threshold, the first symbol of the group involved in a winning payout may be assigned the respective multiplier, or in other embodiments the next time each of the symbols of the group is involved in a winning payout it may be assigned the respective multiplier, etc. Rules may be defined to identify how such payout modifiers and other enhancements are applied.

For purposes of one particular representative example, it is assumed that every symbol in a paytable is assigned a respective countdown counter. In other embodiments, some subset of the available symbols are provided with a countdown timer, such as only those symbols capable of being involved in a payout-bearing symbol combination, or certain high-value symbols, or certain low value symbols, or symbols capable of forming a "scatter pay" (e.g., a minimum threshold number of some symbol, presented anywhere in the play area), or the like.

In one embodiment, each counter has a reset of a predetermined number, which may be the same predetermined number for every symbol, different predetermined numbers for different symbols, or some combination thereof. In other embodiments, the number may not be predetermined, but rather randomly determined, or determined based on other play criteria, or otherwise. In a representative embodiment, each counter has a reset of nine (9), whereby the threshold is therefore nine payouts involving each respective symbol to reach the threshold in which the modifier will be awarded and applied. The payout modifier may be randomly selected in each case (e.g., randomly select a multiplier when any countdown timer reaches its threshold), may be fixed for all symbols collectively (e.g., a 10× multiplier is used for all symbols whose counter reaches the threshold), may be fixed for individual symbols (e.g., a 5× for one symbol and a 10× for another symbol, etc.), etc.

As noted above, in one representative example, every symbol in a pay table is assigned a respective countdown (or count up) counter of nine, and every time a payout of that symbol occurs, regardless of symbol count, the counter decrements by one. When the counter reaches a value of 1, the next payout of that symbol, regardless of symbol count, is assigned a multiplier of 10×. The award of the payout modifier (e.g., multiplier) is therefore known to occur when the counter counts up or down to a threshold value, but is irregular in the sense that the time between providing such multipliers for a particular symbol or group of symbols is irregular and varies, since in one embodiment the count is based on payouts involving the particular symbol or group of symbols, which does not have a patterned or regular interval of occurrence.

FIG. 3 depicts various stages 300A, 300B, and 300C of a symbol-based gaming activity as events occur to advance a counter or other tracker towards a threshold where an award, award modifier, or other player asset may be awarded. In the embodiment of FIG. 3, the tracker is assumed to be a counter (a countdown counter in this example), and the awarded item is assumed to be a multiplier that may be applied to a payout or other player asset to arrive at an enhanced award.

For this example, assume a slot game with the following symbol list shown at stage 300A of FIG. 3. The table of stage 300A depicts progression levels towards a threshold for each of a plurality of gaming symbols or other indicia, such as slot game symbols, that are intended to tracked for potential symbol-based award enhancement. In the example showing stage 300A, for each included symbol 302 included in the feature, a counter 304 is assigned, which are respectively depicted at their various states towards a threshold value, which is assumed to be zero (0) in this example. Thus, in this example, the counter counts down by one to a threshold of zero, although the counter may count up, down, by ones, by multiple numbers, to any threshold number or range of numbers desired. The threshold values may be the same for each symbol, may be different for some or all of the symbols, and may provide the same or different results upon reaching their respective thresholds. In the illustrated embodiment of FIG. 3, symbols M1, M2, M3, and M4 represents symbols having a higher value, and symbols F5, F6, F7, F8, F9 and FA represent symbols having lesser value than the MX symbols, although the principles described herein are applicable to any symbols regardless of their values relative to one another or to other symbols.

In this example, a counter is assigned to each symbol, rather than some or all symbols being assigned in groups. FIG. 3 depicts an example during play of the game where the counter values may be different for various symbols as a result of payouts involving the respective symbols had occurred, thereby decrementing (in this embodiment) its respective counter. For example, the symbol M1 currently as a count value of four (4), and when that value advances towards the threshold of zero (0) and ultimately reaches, it, the payout(s) involving at least the M1 symbol will be multiplied by a multiplier that is known in advance, randomly selected, or otherwise retrieved or derived for application to the winning payout amount(s).

Assume, for example, that on a particular reel spin (gaming event) of a slot game, a four-consecutive M4 symbol 306 combination occurred (also referred to as an M4 4-pay), which is defined as a payout. Also a three-consecutive F6 symbol 308 combination occurred (e.g., F6 3-pay), and their counters would therefore be decremented accordingly in one embodiment, as depicted at stage 300B of FIG. 3. In this example, the M4 symbol 306 is currently associated with the counter value 310 of seven (7), and the F6 symbol 308 is currently associated with the counter value 312 of three (3). In this example, neither of these payouts had their counter reach the threshold level, which is to decrement to a predetermined level (e.g., zero), and consequently no multiplier value is awarded to those payouts as a result of this feature.

Assume on a subsequent slot game reel spin a five-consecutive M2 symbol 314 (M2 5-pay) and a three consecutive F8 symbol 316 (F8 3-pay) occurred. Their respective counters are decremented accordingly, as depicted by the progression from stage 300B to stage 300C of FIG. 3. On this reel spin, the M2 symbol 314 counter 318 was previously at a count value of "1" (stage 3009), so the current M2 5-pay reached its threshold (e.g., decremented to zero) on this reel spin, and the M2 5-pay payout would therefore be multiplied by an awarded multiplier (e.g., 10× in this example). The M2 symbol 314 counter 318 would be reset to nine (9) as depicted at stage 300C.

The F8 symbol 316 (F8 3-pay) would not be awarded a multiplier value as a result of this feature on this spin or other gaining event, as its payout was not associated with a respective counter reaching the threshold level (e.g., count down to zero), but rather its counter 320 was at a count of 9 (stage 300B) and now decremented to 8 (stage 300C).

This feature can be applied with many different counter/multiplier combinations. For example, a 4-pay counter could be paired with a 5× multiplier in one embodiment, or otherwise the multiplier value being dependent on the number of symbols in the payout symbol combination, being dependent on the particular symbol involved, being dependent on the time since the last winning payout, the credits played, etc.

Also, in the embodiments above, the counter decrements and the multiplier applies to any payouts of a symbol type. This could be restricted further to apply to symbol count (e.g., 3-pay, 4-pay, etc.) and symbol type. It could likewise be loosened to apply to all pays regardless of symbol and count. It could also be loosened to apply to all spins that have pays. Such rules may be applied as desired. These and other representative variations are described in greater detail below.

Embodiments described herein may be described in terms of a slot game, although the principles are equally applicable to other games of chance involving symbols or other indicia that arise in connection with play of the game and can be counted or otherwise tracked. Thus, while various embodiments are described in the context of slot games where mechanical or electronic reels provide the randomization of symbols involved in the game, the principles described therewith are equally applicable to other games. Thus, it should be noted that a "reel spin" is one representative manner in which symbols may be randomized and presented for gaming activities described herein, such as slot games. However, any manner of providing symbols that may be used in the gaming activity may be employed. For example, any manner of randomizing symbol positions may be accomplished on any grid, array, or otherwise presented, and do not need to be placed on mechanical or electronic "reels." References to "reels" and symbols on reels are provided for facilitating an understanding of described embodiments, such as in a slot game context where mechanical and/or electronic reels are indeed implemented, but the description herein is clearly not limited thereto. Thus, descriptions in connection with "reels" and associated symbol placement therewith are equally applicable to any symbol randomization and presentation.

Figure 4:
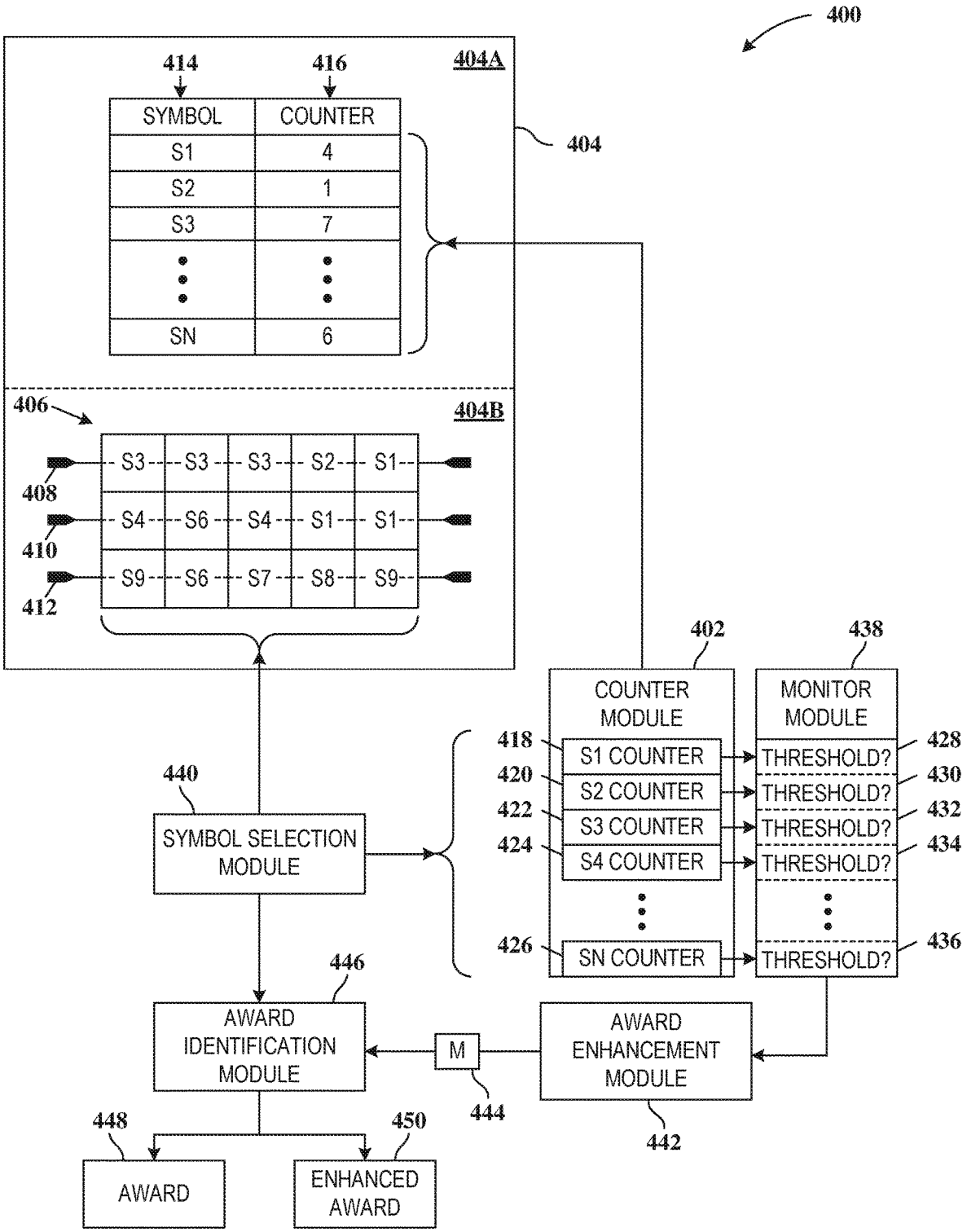
FIG. 4 illustrates a representative embodiment of an operational arrangement of a gaining device that beneficially provides gaming participants with manners of envisaging approaching opportunities to enhance gaming payouts.

FIG. 4 illustrates a representative embodiment of an operational arrangement of a gaining device 400 that beneficially provides gaining participants with manners of envisaging approaching opportunities to enhance gaming payouts. The representative embodiments of FIG. 4 and other embodiments described herein may be implemented using processing hardware, storage, software, etc. FIG. 4 depicts embodiments where a processing arrangement (e.g., single processors, multiple processors, or any other processing arrangement) is programmed with software and/or firmware to provide various modules to perform functions described herein.

The representative gaining device 400 tracks and provides information to players regarding impending, yet at least somewhat indefinite, awards of payout enhancements or grants of other play-related assets. In the illustrated embodiment of FIG. 4, the benefit to the player is provided in the form of a payout modifier, particularly a multiplier, when certain symbols have achieved some result. In the example of FIG. 4, the symbol-based result being tracked is the occurrence of some number of game-related payouts, upon which a multiplier is awarded to increase the associated (and/or other) payout for that event.

For purposes of example, it is assumed that the symbols selected to be part of the feature (may be all symbols, or some subset thereof) will each be associated with a respective count value tracked by a counter 402 module. The symbols that are part of the feature may be displayed via a display 404, which in the illustrated embodiment includes at least a feature progress display portion 404A and a game play portion 404B. The game play portion 404B presents the game involving symbols, such as the depicted slot game 406 having an array of symbols (S1-S9 in this example), which may be column-based reels, individual reels, or otherwise. The depicted slot game 406 may provide payouts in scatter pays (a minimum number of like symbols presented anywhere), on paylines, and/or otherwise. In the illustrated embodiment, it is assumed for purposes of example that the depicted slot game 406 has at least three paylines, identified as horizontal paylines 408, 410, 412. While any symbol combinations may be defined as winning results that provide a payout, for purposes of this example it is assumed that any string of three, four, or five matching symbols along a payline will provide a payout to the player.

In the illustrated embodiment, any time a particular symbol is associated with a winning payout in connection with a "spin" or other gaming event, that symbol's respective counter value will be advanced toward the enhancement feature threshold. In some embodiments, each individual payout for a particular symbol will cause a separate advancement towards the threshold; e.g., if two S1 3-pay combinations (two separate strings of three S1 symbols along a payline) and one S1 4-pay combination (one string of four S1 symbols along a payline) occurred, then the count would be advanced towards the threshold by three, since three winning symbol combinations involving symbol S1 occurred. In other embodiments, regardless of the number of winning symbol combinations that occur involving a common symbol, the count is advanced by one towards the threshold.

In still other embodiments, the advancement towards the threshold (e.g., decrementing count) may occur in larger steps than one, such as by multiple steps towards the threshold, based on other criteria. For example, the advancement/count towards the threshold may correlate to the number of symbols involved in the pay. As a more particular example, a 3-pay for a particular symbol may advance towards the threshold by three, a 4-pay would advance towards the threshold by four, a 5-pay would advance towards the threshold by five, etc. In another representative embodiment, different symbols could jump faster than others, such as S1 symbols causing a count decrement of two, where other symbols cause a count decrement of only one. Thus, the "count" or other tracking values may be manipulated in any desired fashion based on the game or circumstances of the game, and references to single advancements toward the threshold are equally applicable to multiple advancements toward the threshold. Additional variations are described in greater detail below.

For purposes of the present example of FIG. 4, it is assumed that the count will be decremented by one toward a threshold for each symbol involved in a winning payout, regardless of the number of such payouts occurred on that spin/gaming event for that symbol (i.e. if two S1 payouts occurred on the same turn/spin/gaming event, the count would be decremented by only one towards the threshold where the multiplier would be awarded for application to the payout amount).

The display portion 404A may depict a table or other representation to enable the player to see the count values for each of the various symbols in play for the enhancement feature. In some embodiments, other mechanisms, such as speakers, tactile feedback, and/or other perception devices may be included to notify the player of the symbol status in lieu of or in addition to the visual presentation provided via display portion 404A. As seen from the table in display portion 404A, a symbol section 414 lists the symbols available for the enhancement feature, and a corresponding counter section 416 identifies the current count value for each of the symbols. As the slot game is played, the counter section 416 is updated by the counter module 402 which tracks the current count value of each of the symbols via the S1 counter 418, S2 counter 420, S3 counter 422, S4 counter 424, through SN counter 426. When a counter reaches a threshold as determined by its respective threshold determination modules (e.g., comparators) 428, 430, 432, 434 through 436 shown as part of the monitor module 438, a multiplier will be awarded to enhance the payout(s) for that symbol (or in other embodiments for all payouts occurring during that spin).

A particular example is now provided for purposes of facilitating an understanding of some representative operational features. The symbol selection module 440 represents a functional module capable of making the selections of symbols to be utilized for that "spin" or other slot gaming event, which is presented via the depicted slot game 406 of the display portion 404B. In this example, a series of three consecutive S3 symbols occurred in a row, from left to right, on payline 408, which in this embodiment constitutes a winning payout where the counter associated with symbol S3 will be advanced (decremented in this example) towards the enhancement feature threshold (zero in this example). The counter module 402, which is coupled to the symbol selection module 440 such that it is privy to the symbols associated with the particular game/spin, is adjusted based on which symbols had winning combinations. In the present example, the S3 counter 422 recognizes from the symbol selection module 440 that a winning payout occurred with the S3 symbol, which results in the S3 counter 422 being decremented, and updated for player visualization via the counter section 416 of the display portion 404A. Thus, where symbol S3 in symbol portion 414 shows a corresponding count of seven (7) in its associated counter portion 416, that count would be reduced to six (6) as a result of the S3 3-pay shown via the depicted slot game 406.

In addition to maintaining account for each of the symbols associated with the enhancement feature, the counter module 402 is coupled to the monitor module 438 so that each counter 418, 420, 422, 424, 426 can be monitored to determine whether it has reached its threshold via the respective threshold determination modules 428, 430, 432, 434, 436. For example, had the S3 counter 422 reached a count of zero, the threshold determination module 432 would recognize that, and provide the corresponding multiplier, either directly, or through another functional module such as the award enhancement module 442. In one embodiment, different multipliers, whether fixture randomly determined, can be associated with different ones of the symbols, but in the illustrated embodiment is assumed that a common multiplier is awarded by the award enhancement module 442 regardless of which symbol reached the award enhancement feature described herein. Thus, in the current example assuming the S3 counter 422 had reached the count of zero, the award enhancement module 442 provides a multiplier (M) 444, such as a 10× multiplier, that is applied to any award from the S3 symbol as determined by the award identification module 446. In other words, the award identification module 446 determines whether any symbols generated by the symbol selection module 440 resulted in a payout, and if so, an award 448 will be provided to the player. If the threshold condition has been met and the award enhancement module 442 provided a multiplier or other modifier (M) 444, then that award from the award identification module 446 will be multiplied by the multiplier 444 provided by the award enhancement module 442 to arrive at an enhanced award 450.

While any number of symbols of the total symbol set may be used in connection with the award enhancement feature described herein, in one embodiment the number of symbols designated for the feature is made at or near to the number of "counts" from the count reset value to the threshold value. For example, if the count is to be set to ten, such that ten winning events (in this example) for a particular symbol will cause the award enhancement module to provide the modifier 444, then the number of symbols used for the features set to approximately ten. In this manner, where the count is 10, and the number of symbols is approximately 10, at least one counter for one of the symbols statistically be at or near the point where the next one or two (or so) wins for a symbol will result in providing a multiplier 444, where the odds of getting payouts for each symbol is substantially similar. Where the statistical chances of getting payouts on some symbols (e.g., S1) are less likely than other symbols (e.g., S9), then the number of symbols, reset count values, and/or other factors may be changed if it is desired to have at least one counter value at or near the point of awarding a payout modifier. In other embodiments, no such feature uniformity considerations are implemented.

Thus, gaming apparatus embodiments such as those of FIG. 4 may be used in games utilizing symbols or other indicia to identify winning results. In one embodiment, a symbol selection module 440 may be configured to select symbols for the slot game event. A display 404 may be provided to present the selected symbols in a play area or display portion 404B, and to display correlations of designated selected symbols 414 and respective tracking (e.g., counter) values 416. A counter module 402 or other tracking module may be coupled to the symbol selection module 440 to maintain the counter values for each of the designated symbols, and to advance each of the tracking values towards a threshold value in response to its respective designated symbol being involved in a winning symbol combination. A monitor module 438 may be coupled to the tracking/counter module 402 to determine that any of the counter/tracking values reach the threshold value 428, 430, 432, 434, 436. An award enhancement module 442 may be coupled to the monitor module 438 to award a payout enhancement 444 for the winning symbol combinations associated with the designated symbols involved in the winning symbol combinations, in response to the tracking/counter module 402 determining that any of the tracking values reached the threshold value. An award identification module 446 may be provided to provide awards 448 from the winning symbol combinations, and to provide enhanced awards 450 by applying the payout enhancement 444 to the awards 448 for those winning symbol combinations that were awarded the payout enhancement 444.

Figure 5:
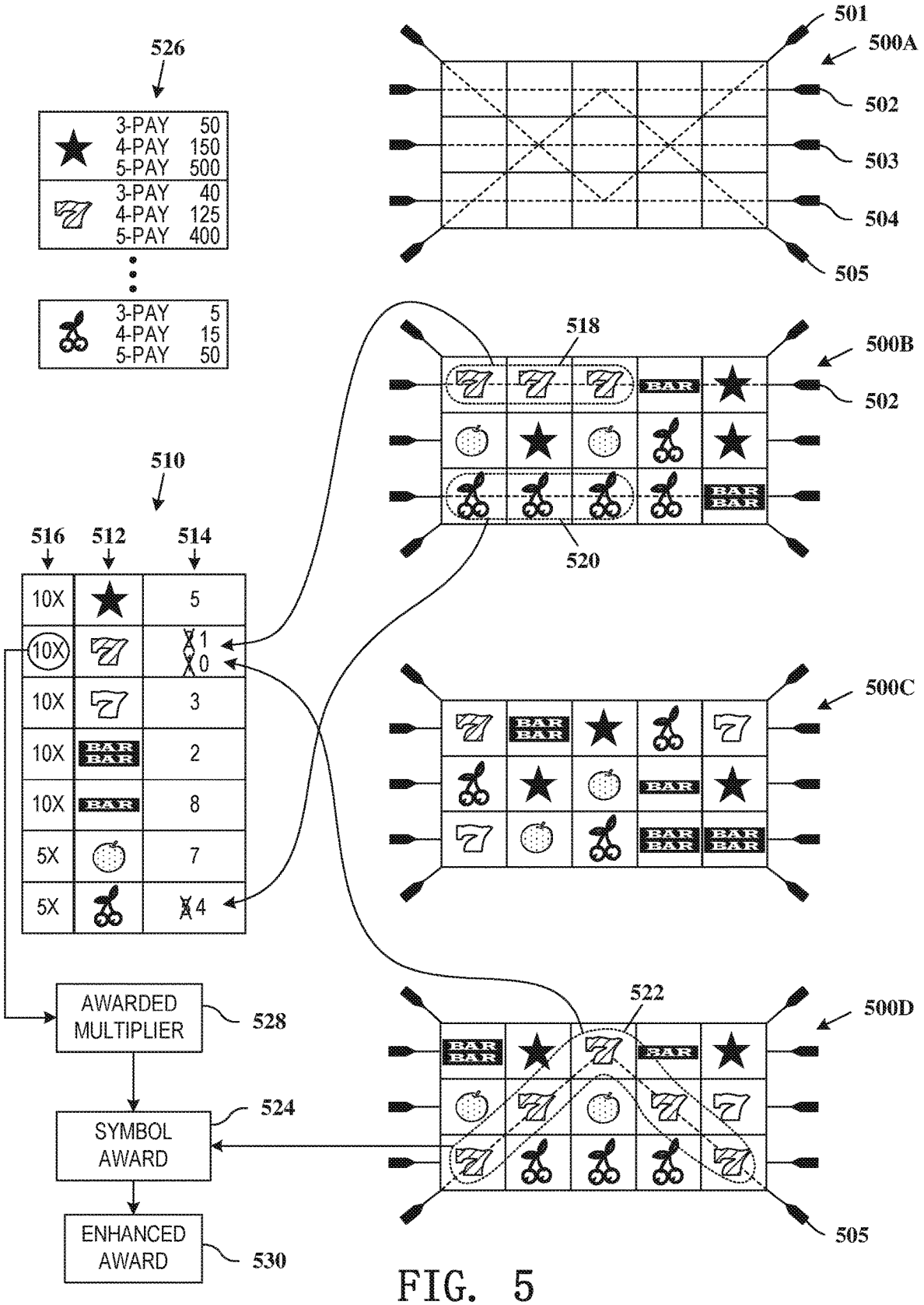
FIG. 5 is a slot game example where symbols involved in payouts for some number of times are awarded a modifier to apply to payout amounts involving those symbols.

FIG. 5 is a slot game example where symbols involved in payouts for some number of tunes are awarded a multiplier to apply to payout amounts involving those symbols. A slot game grid 500A represents a representative slot game grid, which in the illustrated embodiment includes at least five paylines 501, 502, 503, 504, 505 on a 5×3 grid.

Presented table 510 may be presented on a display (not shown), or otherwise presented to the player. The table 510 includes a list of symbols 512 associated with the payout enhancement feature, along with a current count 514 for each of the symbols 512, and further along with a potential multiplier 516 when the corresponding symbol's count reaches its threshold value. Thus, in some embodiments, the multiplier or other modifier may differ based on the symbol, and/or other factors associated with the game. At a current state, the count values for each of the symbols moving vertically downward on the table 510 are 5, 2, 3, 2, 8, 7 and 5.

Slot game grid 500B results when populated with symbols. In this example, two different payouts occurred in connection with the symbol randomization and presentation shown on slot game grid 500B. A 3-pay (i.e. 3 consecutive matching symbols on a payline) of shaded seven symbols, identified by dashed line 518, causes the corresponding current count 514 to be decremented by one, as depicted by the crossed-out 2 and replacement with a count of 1 next to the shaded seven symbol of table 510. Additionally, a 3-pay of cherry symbols, identified by dashed line 520, causes the corresponding current count 514 to be decremented by one, as depicted by the crossed-out 5 and replacement with a count of 4 next to the cherry symbol of table 510. As can be seen, in this embodiment, the count 514 will be decremented towards a threshold value of zero each time a payout involving that symbol is awarded. As noted elsewhere herein, in one embodiment the counter may be decremented by the number of times a particular symbol has a winning payout on a particular spin, where in other embodiments the counter may be decremented by one regardless of the number of times a particular symbol has a winning payout on that particular spin. The present example assumes the latter, where the counter is decremented by one for a particular symbol no matter how many winning combinations on that symbol grid occur on that spin.

Slot game grid 500C results in connection with the next slot game spin, where no winning symbol combinations occurred. In such case, the current count 514 is not advanced towards its threshold for any of the symbols 512 subject to the enhancement feature as identified in table 510.

Slot game grid 500D depicts a subsequent spin, which involves a winning payout for the shaded seven symbol on payline 505 as depicted by dashed line 522. This causes the current count 514 associated with the shaded seven symbol 512 to decrement from 1 to 0, which is the threshold count in the current example. Therefore, an award enhancement is now awarded as a result of the current count 514 reaching the threshold of zero for the particular shaded seven symbol 512. A symbol award 524 is provided, such as 400 credits based on the representative paytable 526, as a result of the shaded seven 5-pay symbol combination shown at slot game grid 500D. A. 10× multiplier 516 is associated with the shaded seven symbol 512, and since the current count 514 has reached the threshold condition of a count of zero (in this example), the 10× multiplier is awarded 528, which results in the enhanced award 530.

As previously noted, their various alternative manners in which symbol combinations and/or other triggering events can be counted or tracked towards the threshold where an award modifier or other player asset may be awarded. FIGS. 6A-6F depict representative rule-based variations of when and/or how to enable the advancement towards the award enhancement features.

Figure 6A:
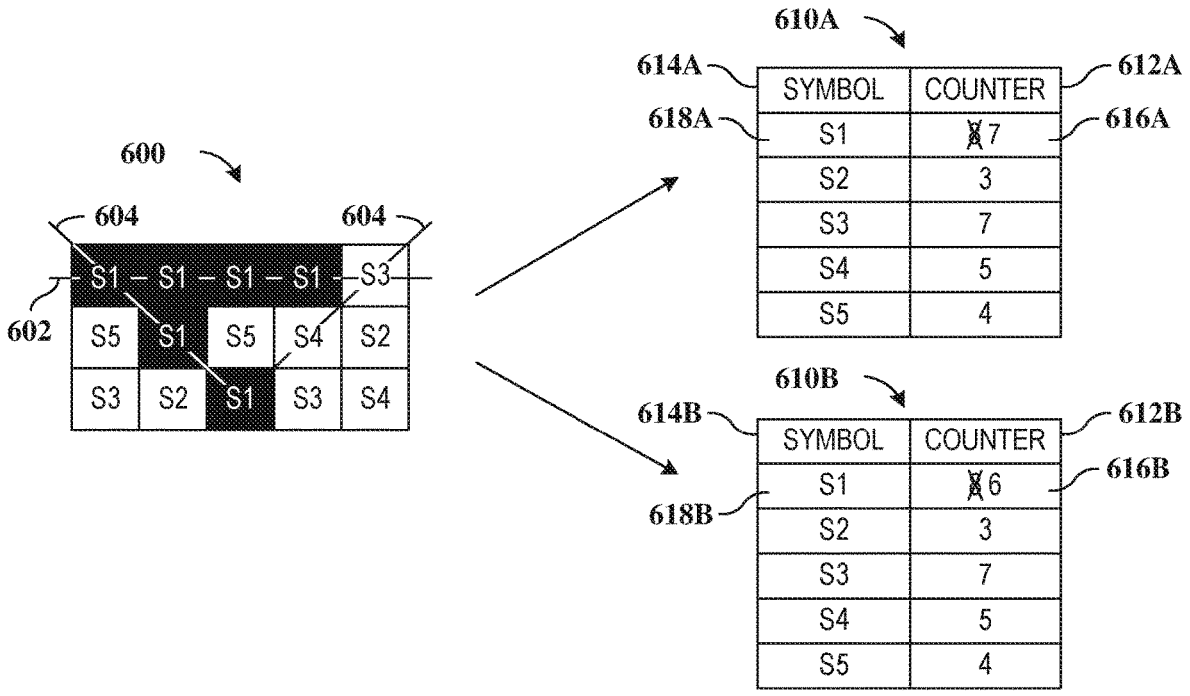
FIGS. 6A-6F depict representative rule-based variations of when and/or how to enable the advancement towards the award enhancement features.

FIG. 6A depicts alternative illustrative manners as to how the count towards the feature threshold may be implemented. The representative slot game grid 600 is used for purposes of this example, which is a 3×5 symbol grid where the symbols may be presented randomly in each cell of the grid, or may be associated with vertically spinning reels, or the like. The example includes some number of symbols, including at least symbols S1-S5.

In a first example, the symbol-count table 610A details a visually-available symbol-to-counter association, showing a current count 612A for each symbol 614A of interest. For example, the symbol S2 of the symbol-count table 610A shows a current count of three (3), meaning that in three more payouts of the S2 symbol, a payout modifier or other enhancement feature will be granted. For purposes of this example, it is assumed that two payouts were provided in connection with the S1 symbol, on paylines 602 and 604. Specifically, an S1 4-pay has occurred on payline 602, and an S1 3-pay has occurred on payline 604. In accordance with one embodiment, even though there were multiple (i.e. two) winning S1 symbol combinations occurring on the slot game grid 600, the embodiment of symbol-count table 610A shows that the count 616A for the S1 symbol 618A decremented from 8 to 7, meaning that it only decremented by one value.

In an alternative embodiment, the symbol-count table 610B similarly details a visually-available symbol-to-counter association, showing a current count 612B for each symbol 614B of interest. However, in this example, the count 616B is decremented for each winning payline that occurs for its associated symbol. For example, for symbol S1 618B shown in symbol-count table 610B, the count 616B has decremented by two, from 8 to 6, since there were two winning symbol combinations involving the S1 618B symbol (i.e. on paylines 602 and 604). Still other rules may be implemented to further impact how the counter 612A/612B may operate in view of game play situations. Considerations as to which of the various manners of advancing towards the threshold condition may include the size of the game play grid, the number of paylines, the number of different symbols used, the number of each symbol used, and the like.

Figure 6B:
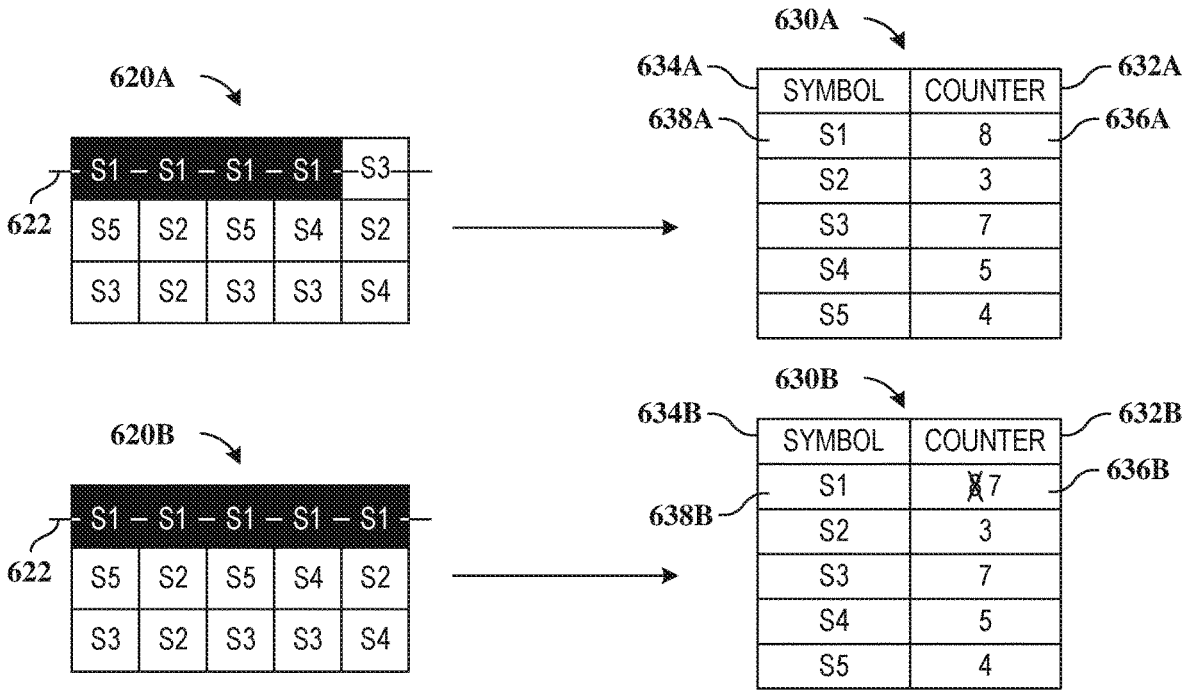

FIG. 6B illustrates another example of a rule when a counter will advance toward the threshold. In this example, the symbol-count table 630A shows a current count 632A for each symbol 634A of interest. For purposes of this example, it is assumed that an S1 4-pay has occurred on payline 622 of slot game grid 620A. In accordance with one embodiment, even though there was a winning combination for the S1 symbol 638A that may have provided a payout on payline 633 of slot game grid 620A, this does not meet the rule of this representative embodiment. The rule in this example is to advance the counter 632A towards the threshold when a symbol is involved in a 5-pay award, such as shown on slot game grid 620B. Therefore, with such a rule, the count 636A of symbol-count table 630A does not change, and there is no advancement for the S1 symbol (or other symbols as there were no winning symbol combinations) towards the threshold to ultimately provide a payout enhancement. However, the count 636B of symbol-count table 630B does change, as an S1 638B 5-pay symbol combination occurred on payline 622 of slot game grid 620B, and therefore the count 636B is decremented towards a threshold value, from 8 to 7 in this example. As can be seen, rules may be implemented to determine when to enable the count or other tracking feature to advance towards a threshold value where the award modifier or other player asset may be awarded to the player.

Figure 6C:
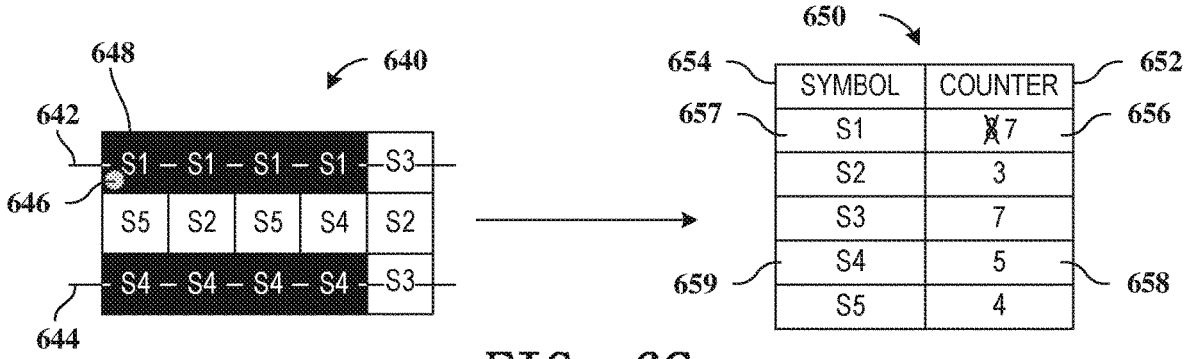

In one embodiment, the award enhancement feature is not enabled for a particular spin until some other event(s) occurs. For example, in one embodiment, an indicator may be provided, such as a visual indicator associated with a symbol, and/or with a symbol location, and/or elsewhere in connection with the game play. Such an indicator may in essence enable the award enhancement feature described herein, thereby allowing a count or other tracking mechanism to be advanced towards the award/award modifier grant threshold when the indicator(s) is present or presents an indicator that the feature is enabled. FIG. 6C illustrates a representative example of a condition-based enablement of the award enhancement features described herein.

In the example of FIG. 6C, a slot game grid 640 depicts two winning symbol combinations which, in this embodiment, each provide a winning payout. Specifically, an S1 4-pay occurred on payline 642, and an S4 4-pay occurred on payline 644. An indicator 646, such as a sub-symbol, color, highlight or outline, special symbol, and/or any other perceivable indicator, essentially "activates" or enables the S1 symbol to be subject to the award enhancement features described herein. Therefore, the symbol-count table 650 reflects that the S1 symbol 657 counter 656 has been decremented by one, from 8 to 7, as a result of both the S1 4-pay and the indicator 646 being present. Alternatively, the S4 4-pay on payline 644 does not reflect a change to the S4 symbol 659 counter 658, as no similar indicator is associated with the S4 symbol combination occurring on payline 644. Indicator(s) 646 may be provided randomly, or in connection with some other event. In one embodiment, since the indicator may not be associated with every winning payout for the symbols subject to the award enhancement feature, the count required to reach the threshold may be set to a lower value.

Figure 6D:
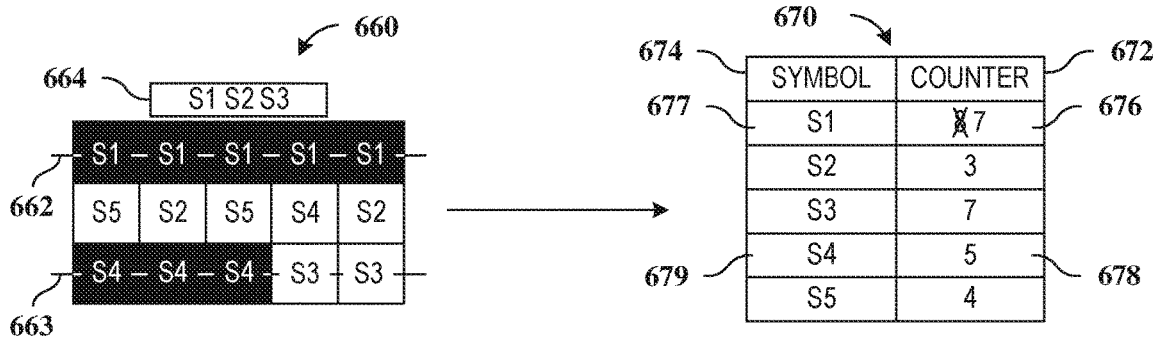

In an analogous fashion, the example of FIG. 6D illustrates another condition-based advancement towards obtaining an award via the award enhancement features described herein. The slot game grid 660 depicts two winning symbol combinations, an S1 4-pay, on payline 662, and an S4 3-pay on payline 663. A symbol identifier 664 may be provided to identify which, if any, symbols are activated for the present slot game event (e.g., spin event). For example, the symbol identifier may identify one or more symbols that are to be activated on (at least) the present spin or other gaming event. Any perceivable manner of identifying such qualifying symbols may be implemented. In this example, the symbol identifier 664 lists three qualifying symbols for this particular reel spin, including the S1, S2 and S3 symbols. Therefore, the symbol-count table 670 reflects that the S1 symbol 677 counter 676 has been decremented by one, from 8 to 7, as a result of both the S1 4-pay and the S1 symbol being among the qualifying symbols in the symbol identifier 664. Alternatively, the S4 3-pay on payline 663 does not reflect a change to the S4 symbol 679 counter 678, as S4 is not among the qualifying symbols in the symbol identifier 664 for this particular reel spin(s) or other gaming event(s). Symbols in symbol indicator(s) 664 may be provided randomly, or in connection with some other event. Since the symbol indicator 664 may limit the frequency of winning symbol combinations advancing towards the award enhancement threshold, the count required to reach the threshold may be set to a lower value in some embodiments.

Figure 6E:
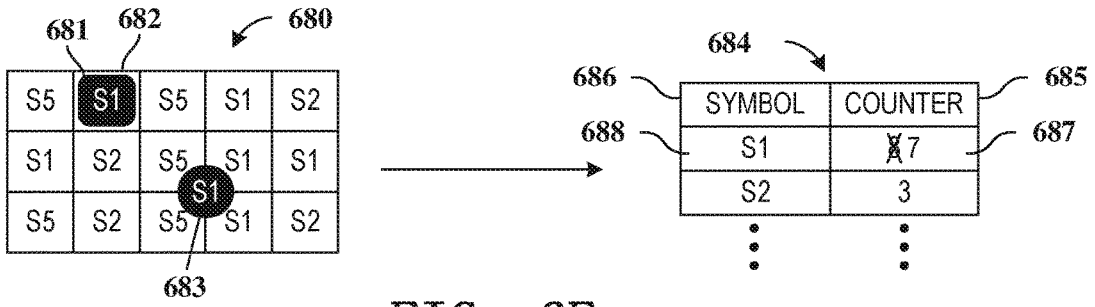

In another embodiment, the symbols presented in the slot game grid as part of the gaming event itself are not involved in triggering the advancement towards the threshold. FIG. 6E illustrates an embodiment where an indication outside of the symbols otherwise used in the gaming event identifies what, if anything, is to be advanced towards the threshold where the award, modifier, or other player asset is awarded. For example, the slot game grid 680 depicts an overlay symbol(s) 681 at symbol location 682, where a symbol(s) can randomly appear, or appear based on other game criteria, at one or more symbol locations to replace another symbol. Such an overlay symbol 681, whether used in connection with the game grid combinations or not, may be used to indicate which symbol(s) are to have their tracking values advanced towards the threshold. As another example, an overlay notification 683, or notification presented anywhere within or outside the slot game grid 680, may identify the symbol(s) that are to have their tracking values advanced towards the threshold. In such cases, the symbol-count table 684 would reflect a change to the counter 687 for the symbol S1 688 where the overlay symbol 681 is presented, overlay notification 683 is presented, sub-symbol is presented (not shown), and/or other indication of which item is to be advanced towards the threshold is presented.

Figure 6F:
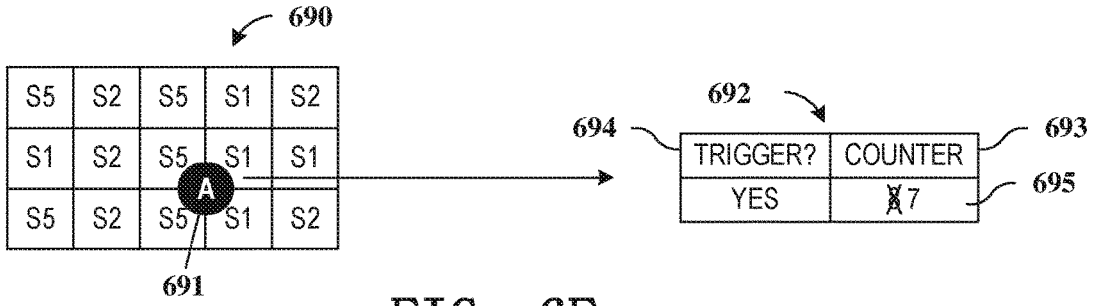

In still another embodiment, overlays, sub-symbols, or other indicia outside of the symbols used as part of the gaming event may be used to advance towards the threshold. FIG. 6F depicts an example of a slot game grid 690 where an overlay 691, sub-symbol, displayed character(s) and/or other notification provides an indication that a counter or other tracking value should advance towards a state where an award, modifier, and/or other player asset may be awarded. The trigger-count table 692 depicts the advance condition, which in this embodiment is to allow advancement of a counter 693 when a particular trigger(s) occurs, such as the overlay 691 indicating to advance the counter 693 towards the threshold. In such an embodiment, when the counter reaches the threshold, any desired action may occur, such as applying a multiplier towards any and all payouts occurring on the spin (or a subsequent spin) in which the threshold was met. In the illustrated embodiment of FIG. 6F, the counter 693 value 695 is shown to decrement from 8 to 7 as a result of the overlay symbol 691 indicating that the count value 695 should be decremented.

Figure 7A:
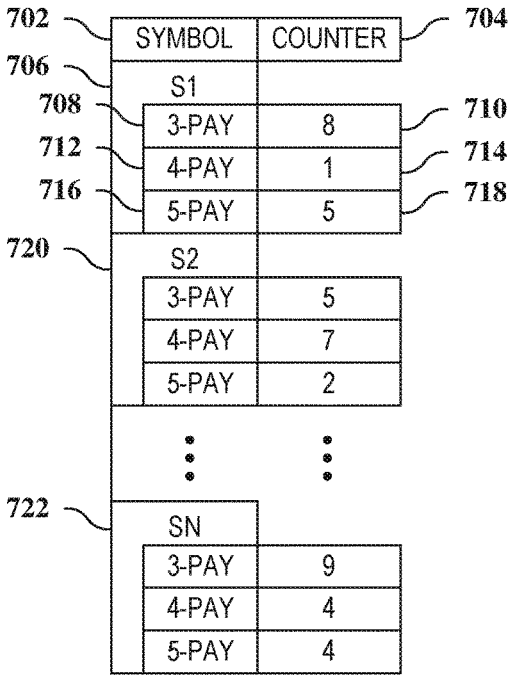
FIGS. 7A and 7B illustrate representative embodiments for awarding payout enhancements where both symbol type and quantity of symbols associated with a payout are considered in the advancement towards reaching the award enhancement threshold.
Figure 7B:
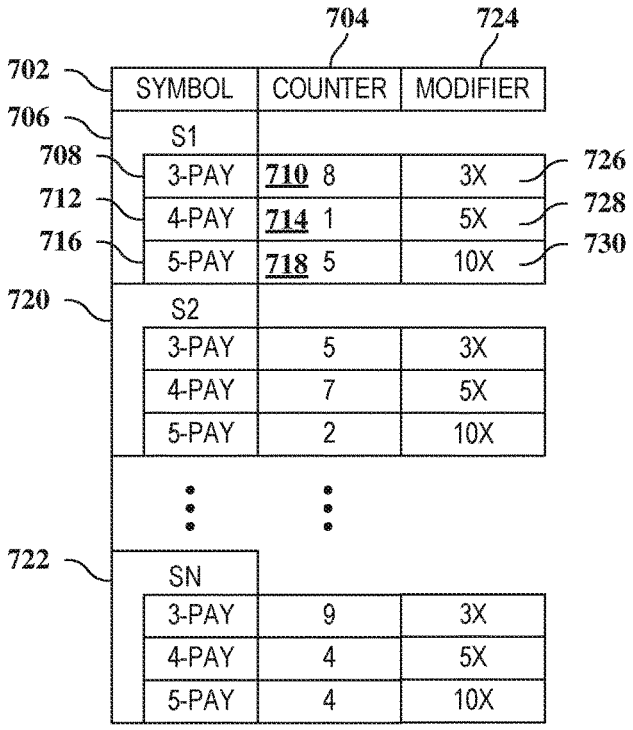

Another representative variation involves a greater degree of specificity and tracking of count values. In this embodiment, separate counts may be maintained for multiple winning symbol combinations involving the same symbol. FIGS. 7A and 7B illustrate representative embodiments of a variation where both symbol type and quantity of symbols associated with a payout are considered in the advancement towards reaching the award enhancement threshold.

Referring to FIG. 7A, the symbol-count table 700A provides a correlation between each symbol payout condition 702 and an associated counter 704. In this example, it is assumed that for the symbols of interest, winning symbol combinations include three symbols in a row (3-pay), four symbols in a row (4-pay), and five symbols in a row (5-pay). In the embodiment of FIG. 7A, each of the different symbol combination quantities for a given symbol are associated with its own counter. For example, rather than any payout for a particular symbol S1 706 being the cause for advancing the counter towards a threshold, an S1 3-pay 708 may have a designated counter 710, an S1 4-pay 712 may have a separate counter 714, and an S1 5-pay 716 may have a separate counter 718. This could be similarly done for any one or more of the symbols 706, 720, 722.

FIG. 7B depicts another embodiment, with an even greater degree of specificity. Using like reference numbers as those of FIG. 7A, the embodiment of FIG. 7B illustrates that in addition to providing separate count values for different winning conditions for particular symbols, specific modifiers 724 or other awards can be associated therewith. For example, an S1 3-pay 708 may have a designated counter 710 leading to a 3× multiplier 726, an S1 4-pay 712 may have a separate counter 714 leading to a 5× multiplier 728, and an S1 5-pay 716 may have a separate counter 718 leading to a 10× multiplier 730. This could be similarly done for any one or more of the symbols 706, 720, 722.

Figure 8:
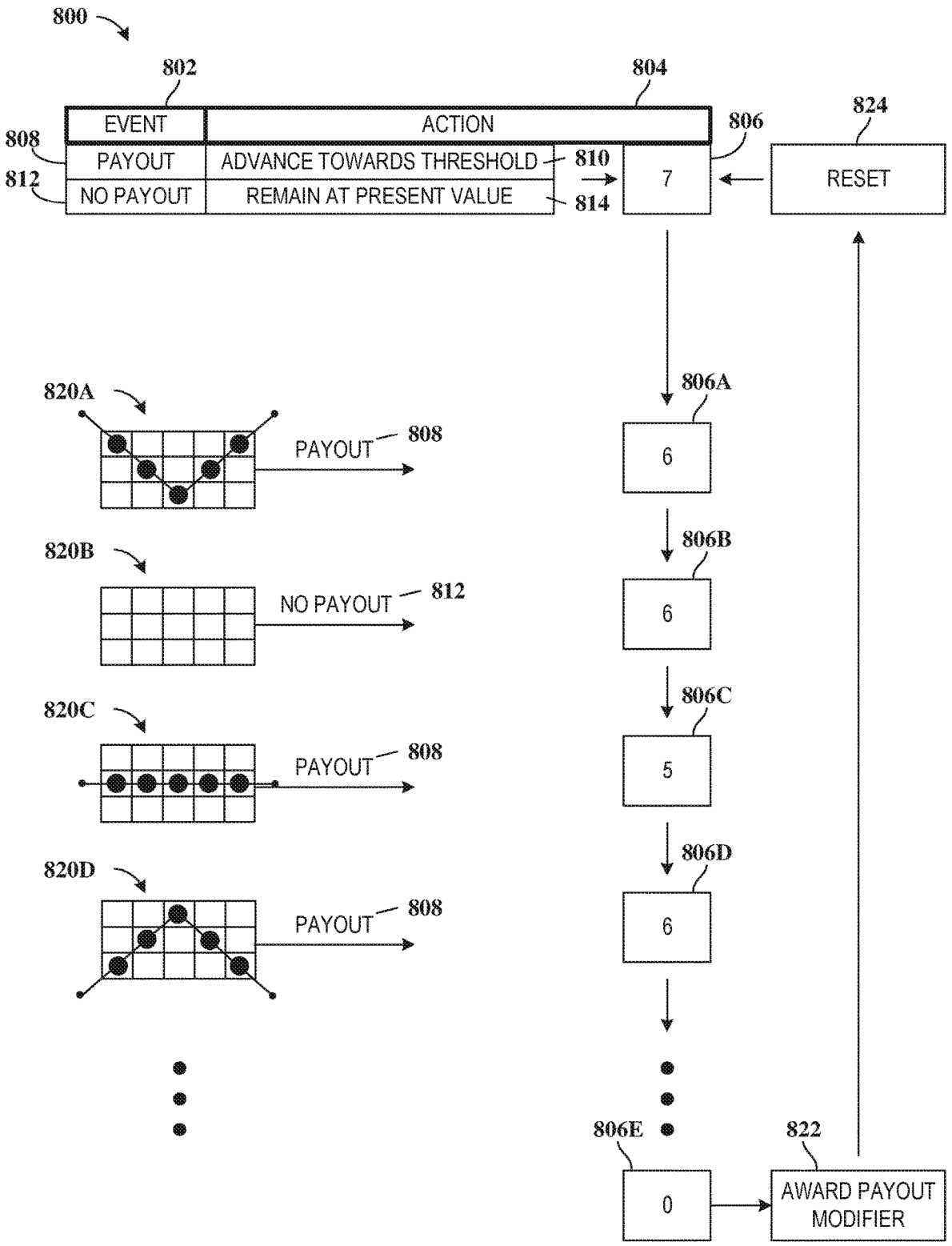
FIG. 8 depicts an example where the count of payouts, independent of which symbol(s) or how many symbols were involved in the payouts, advances the feature towards the granting of an award enhancement.

In still another representative variation, the symbols involved in payouts are not relevant to the advancement towards the threshold in which the award or award modifier is presented to the player. FIG. 8 depicts an example where the count of payouts, independent of which symbol(s) or how many symbols were involved in the payouts, advances the feature towards the granting of an award enhancement.

In the embodiment of FIG. 8, a symbol-count table 800 identifies an occurrence of an event 802, and an action 804 (e.g., a count towards receiving an award enhancement). The current count 806 in the representative symbol-count table 800 is assumed to be seven (7), and it will also be assumed for purposes of this example that upon being reset, the current count 806 will be reset to nine (9). In this embodiment, when the event 802 is that a payout 808 occurred during that "spin" or other gaming event, the current counter 806 will advance 810 towards the threshold; and when the event 802 is that no payout 812 occurred, the current counter 806 will remain 814 at its present value—i.e. the count will not be advanced towards the threshold.

Slot game grid 820A depicts a winning condition on a payline, which results in a payout 808. Whether there are one or more winning symbol combinations (and/or other "winning" conditions such as a mystery pay, scatter pay, etc.), a payout 808 is indicated, which according to symbol-count table 800 causes an advance 810 towards the threshold. This results in the current counter 806A being decremented (in this example) towards the threshold where a multiplier or other award/award enhancement may be won.

Assume that on a subsequent spin of a slot game, slot game grid 820B depicts no winning condition on any payline, which results in no payout 812. According to symbol-count table 800, the current counter 806B remains 814 at its present value where there is no payout 812. Assume that on another subsequent spin, slot game grid 820C depicts a winning condition on a payline, which results in a payout 808. In accordance with symbol-count table 800, this causes an advance 810 towards the threshold. This results in the current counter 806C being decremented towards the threshold where a multiplier or other award/award enhancement may be won. Assume that on still another subsequent spin, slot game grid 820D depicts a winning condition on a payline, which results in a payout 808. In accordance with symbol-count table 800, this causes an advance 810 towards the threshold. This results in the current counter 806D again being decremented towards the threshold where a multiplier or other award/award enhancement may be won.

As seen from this representative embodiment, the current counter 806 will advance towards the threshold to award the multiplier, modifier, and/or other award each time there is any winning condition associated with other play of the game. When the current counter 806 ultimately reaches the threshold 806E, the payout modifier(s) 822 (and/or other award) is provided, and the current counter 806 is reset 824 to begin a new advancement towards the threshold 806E and awarded payout modifier 822.

Figure 9:
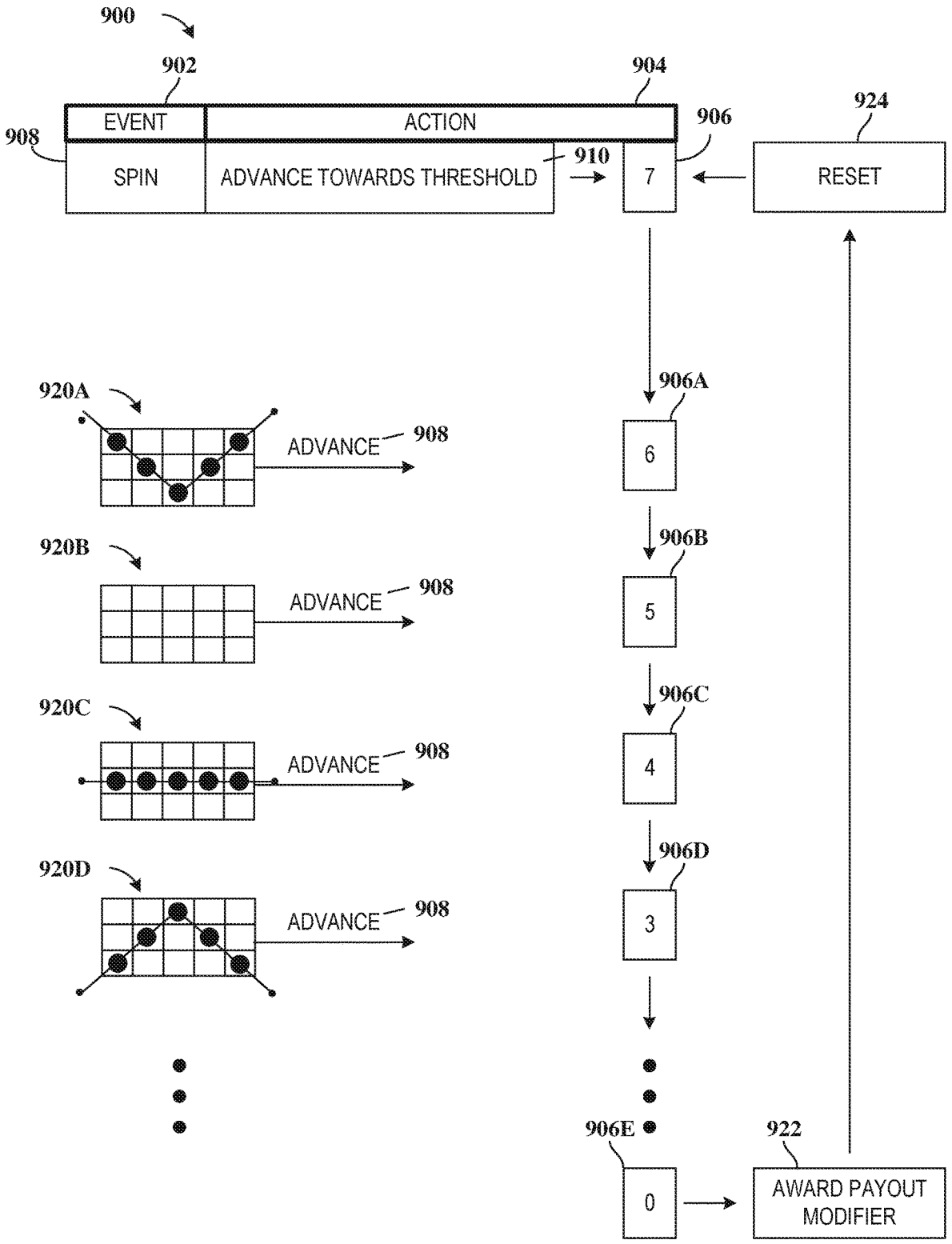
FIG. 9 depicts an example where the count of reel spins (and/or other analogous gaming event segments), independent of which symbol(s) or how many symbols were involved in the payouts, advances the feature towards the granting of an award enhancement.

In yet another representative variation, rather than providing advancement towards the threshold in which the award/award modifier is presented upon any win, the embodiment of FIG. 9 provides advancement towards the threshold upon participation in any spin or other gaming event or segment. Thus, the counter or other tracker is advanced on each play of the gaming activity. What constitutes a "play" in this regard may be defined, such as a spin event in a slot game, a hand in a poker game, etc.

In the example of FIG. 9, a symbol-count table 900 identifies an occurrence of an event 902, and an action 904 (e.g., a count towards receiving an award enhancement). The current count 906 in the representative symbol-count table 900 is assumed to be seven (7), and it will also be assumed for purposes of this example that upon being reset, the current count 906 will be reset to nine (9). In this embodiment, when the event 902 is that a spin (or other gaming event) 908 occurred during play of the gaming activity, the current counter 906 will advance 910 towards the threshold.

Slot game grid 920A depicts a winning condition on a payline, which results in a payout 808. Because a spin 908 occurred, whether or not it resulted in a payout or any other condition, which according to symbol-count table 900 causes an advance 910 towards the threshold. This results in the current counter 906A being decremented (in this example) towards the threshold where a multiplier or other award/award enhancement may be won.

Assume that on a subsequent spin of a slot game, slot game grid 920B depicts no winning condition on any payline, and therefore results in no payout. According to symbol-count table 900, it is not determinative whether any payout occurred (or any other condition), but only that another spin 908 occurred. Therefore, the current counter 906B is again decremented towards the grant of an award enhancement feature. Assume that on two additional subsequent spins, slot game grids 920C and 920D respectively depict winning conditions on a paylines, to which payouts may be awarded in connection with the standard game rules. In accordance with symbol-count table 900, each spin, whether or not it resulted in a winning result, causes an advance 910 towards the threshold. This results in the current counter 906C and 906D being decremented towards the threshold where a multiplier or other award/award enhancement may be won.

As seen from this representative embodiment, the current counter 906 will advance towards the threshold to award the multiplier, modifier, and/or other award each time the player engages in another spin, which may be specifically defined in any desired manner (i.e. base game spins that were paid for, free games, etc.). When the current counter 906 ultimately reaches the threshold 906E, the payout modifier(s) 922 (and/or other award) is provided, and the current counter 906 is reset 924 to begin a new advancement towards the threshold 906E and awarded payout modifier 922.

Figure 10:
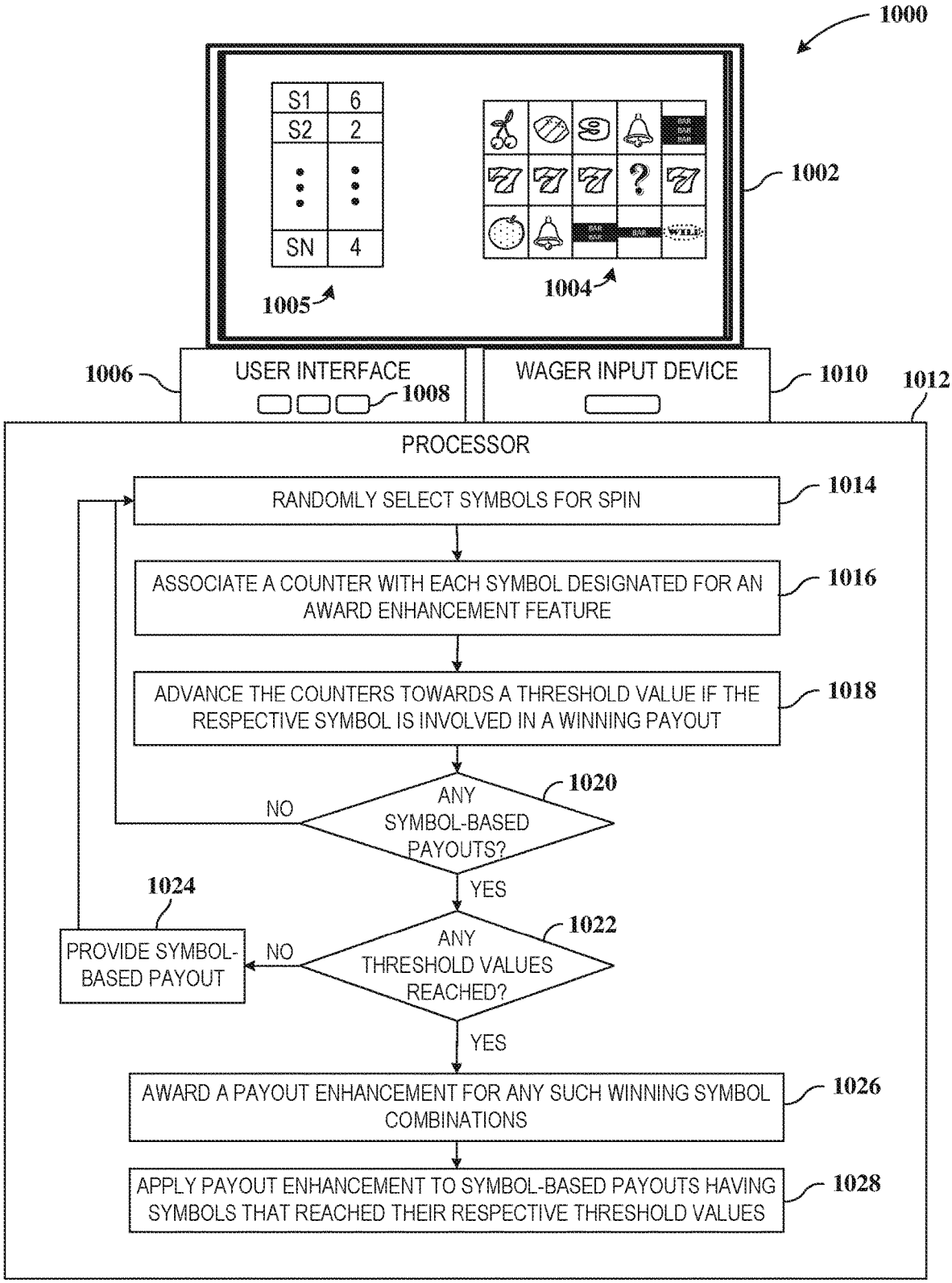
FIG. 10 is a block diagram of a representative gaming apparatus for enhancing payouts by tracking gaming occurrences in gaming activities.

FIG. 10 is a block diagram of a representative gaming apparatus for enhancing payouts by tracking gaming occurrences in gaming activities. In the embodiment of FIG. 10, a symbol-based gaming apparatus (e.g., slot game device) 1000 is provided on which players can play slot games. Other games may instead be used as a primary game, such as poker, or other games involving symbols or indicia in the determination of winning results. The representative slot game device 1000 includes at least a display(s) 1002 presenting a slot game symbol array or "grid" 1004 of symbols, as well as presenting correlations 1005 of selected symbols and respective tracking values, such as count values. A user interface 1006 is provided that includes at least one user input 1008 to enable a player to initiate and participate in slot game events presented via the slot game grid 1004, and a wager input device 1010 structured to identify and validate player assets and ultimately permit the player to play the slot game event when the player assets are provided.

A processor 1012 is configured to randomly select 1014 symbols for a slot game spin (or for indicia in other indicia-based games). The processor 1012 associates 1016 a counter with each symbol designated for an award enhancement feature (e.g., a multiplier), and the counters are advanced 1018 towards a threshold value if the respective symbol is involved in a winning payout. The processor 1012 determines 1020 whether any symbol-based payouts are to be provided, and if not, the next spin can be performed by again randomly selecting 1014 symbols for the next spin. Otherwise, if the processor 1012 determines 1020 that any payouts are to be provided, it is determined 1022 whether any of such symbol-based payouts are associated with symbols whose corresponding counter has reached its respective threshold value. If not, the symbol-based payout may be provided 1024, and the next spin can be performed by again randomly selecting 1014 symbols. However, if it is determined 1022 that any of the symbol-based payouts are associated with symbols whose corresponding counter has reached its respective threshold value, a payout enhancement is awarded 1026 for any such winning symbol combinations. This awarded payout enhancement may then be applied 1028 to the symbol-based payouts having symbols that reached the respective threshold values.

Another similar embodiment includes a display that presents symbols in symbol locations forming a symbol array, and presents correlations of specified symbols and respective counter values. A user interface includes user inputs to allow players to initiate and participate in slot game events presented via the symbol array (e.g., reel spins). In such an embodiment a wager input device is provided to identify and validate player assets, and to permit the player to play the slot game event when the player assets are provided. A processor, comprising any processing arrangement, is configured to randomly select some (which could include all) of the symbols for positioning in the symbol locations of the symbol array in response to initiating of a slot game event. The processor is configured to advance the counter values associated with each of the specified symbols if the respective specified symbol is involved in a result of the slot game event involving a payout, to monitor for any of the counter values reaching a threshold, and for any of the counter values reaching the threshold to award a respective payout modifier. The processor is further configured to increase the payout of the slot game events whose counter values have reached the threshold by mathematically applying its respective payout modifier thereto.

Figure 11:
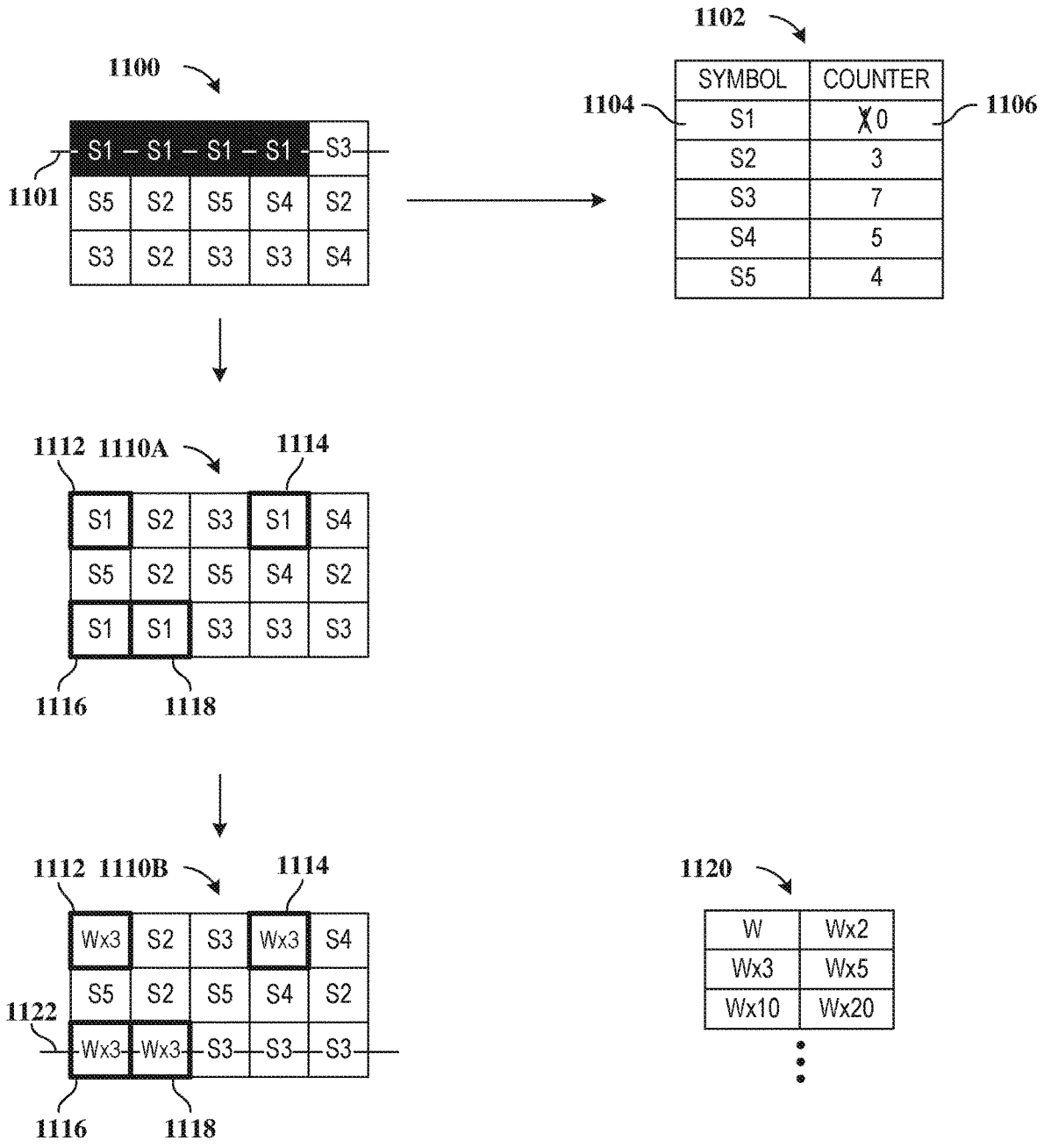
FIG. 11 depicts an example of some representative player assets that may be provided that differ from modifiers of other payouts.

As noted herein, any type of award, award enhancement, increased-value opportunity, and/or other player asset may be provided in connection with reaching threshold conditions. Thus, while numerous examples set forth herein are described in the context of payout modifiers (e.g., multipliers that may increase payout), any gaming award or benefit may be provided in connection with reaching the threshold conditions established for the particular gaming activity. FIG. 11 depicts an example of some representative player assets that may be provided that differ from modifiers of other payouts.

In the example of FIG. 11, a slot game grid 1100 reveals a symbol combination of S1 symbols resulting in an S1 4-pay winning combination on payline 1101. In this embodiment, the symbol-count table 1102 illustrates that this S1 1104 winning symbol combination causes a count value 1106 to decrement from 1 to 0, thereby reaching a threshold of zero in this example. In this embodiment, rather than granting a payout modifier or direct award, the benefit is provided on a subsequent gaming event. For example, the benefit may be provided on the next slot game reel spin, such as providing wild symbols, wild symbols with a multiplier or other modifier, free games symbols, bonus symbols, and/or other possibilities on the slot game grid 1100. In the illustrated example, it is assumed that when the count value 1106 reaches its threshold value, on the next spin result depicted by slot game grid 1110A, any symbol locations 1112, 1114, 1116, 1118 where the threshold-meeting symbol 1104 is presented on the slot game grid 1110A will be replaced or otherwise updated. This is depicted at slot game grid 1110B, where symbols that were in symbol locations 1112, 1114, 1116 and 1118 have been replaced. In one embodiment, what gets replaced at the symbol locations may be randomly selected, and may be high value symbols, bonus symbols, wild symbols, multiplier symbols, etc. In the illustrated embodiment, it is assumed that the replacement symbols will be wild symbols, and or wild symbols plus multipliers, and in the specific embodiment of slot game grid 1110B, the replacement symbol is a wild symbol with a 3× multiplier (W×3). In other embodiments, different wild/wild+multiplier symbols may be provided in different symbol locations identified for replacement symbols. In still another embodiment, the symbol(s) to replace the symbols at the identified symbol locations 1112, 1114, 1116, 1118 may be obtained from a table 1120 or other storage where a symbol(s) or value(s) may be selected. By updating symbols in this fashion, on the spin event associated with the slot game grid 1110B as updated, a potentially better outcome may be possible. In the illustrated embodiment, replacing symbols at symbol locations 1112, 1114, 1116 and 1118 with W×3 symbols provides an S3 5-pay (i.e. a 5-symbol-long combination of S3 symbols), which will get a payout, and a multiplication of that payout by three in view of the symbol replacement.

Figure 12:
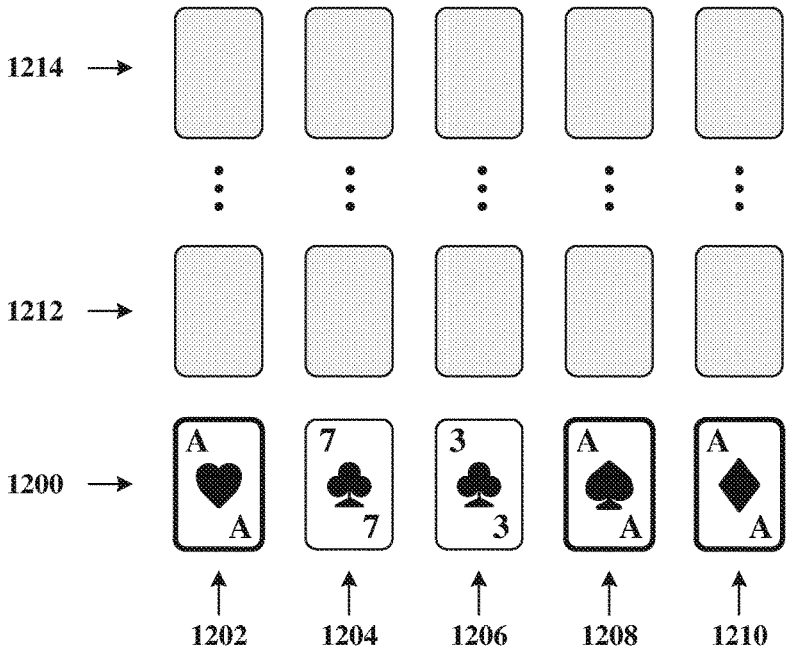
FIG. 12 illustrates representative poker embodiments, where poker-related results can be tracked for enhanced awards when threshold conditions are met.

The principles described herein may be applied to any number of gaming activities involving symbols or other indicia that may be counted, monitored, or otherwise tracked towards thresholds where an award and/or award enhancement(s) may be provided. For example, winning poker hand results in any poker environment may be counted or otherwise tracked, and payout enhancements may be provided when any of the winning poker hand results occurs when the count or other tracking reaches a threshold. FIG. 12 illustrates representative poker embodiments, where poker-related results can be tracked for enhanced awards when threshold conditions are met.

In this example, an initial hand 1200 of cards 1202, 1204, 1206, 1208, 1210 is dealt. The single hand 1200 may be played as a stud poker hand, draw poker hand, or any other type of poker hand. A poker hand-counter table 1220 may be used in one embodiment, which includes a running count value 1222 for particular poker hands 1224. If a count value 1222 is advanced to reach a threshold value, an award enhancements may be provided for the hand or hands whose counters (or other trackers) reached their respective threshold values. For example, the counter value 1222 for obtaining a flush 1224A is at two (2). If the count decrements towards a threshold value of zero (0), an award enhancement would be provided upon receive of two more flushes. The award enhancement is applied, in one embodiment, to any payout that the flush 1224A paid in connection with the standard poker game.

In another embodiment, a poker hand characteristic-counter table 1230 is used, which includes a running count value 1232 for particular poker hand characteristics 1234. If a count value 1232 is advanced to reach a threshold value, an award enhancements may be provided for the hand characteristics whose counters (or other trackers) reached their respective threshold values. For example, the counter value 1232 for obtaining a flush in clubs 1234A is at one (1). In a count decrementing embodiment where zero is the threshold for providing an award enhancement, if the count decrements one more time, the award enhancement would be provided as the counter 1232 will decrement to zero (0). The award enhancement may then be applied to any payout that the flush of clubs 1234A paid in connection with the standard poker game. The examples of tables 1220 and 1230 are provided for purposes of illustration, and not of limitation, as other analogous conditions-to-tracking methodologies may be utilized.

Additionally, the principles described in connection with FIG. 12 and otherwise herein are applicable to single poker hands, multiple poker hands, or any other poker varieties where winning results may be counted or otherwise tracked. For example, FIG. 12 also depicts a multi-play poker variation, where multiple hands 1200, 1212, 1214 are concurrently played, whether played independently or otherwise. For example, in a multi-play draw poker context, an initial hand 1200 of cards may be dealt, and cards held in that initial hand 1200 may be replicated into one or more other concurrently played poker hands 1212, 1214. In one embodiment, any of the multiple hands 1200, 1212, 1214 and their potential winning results may be considered when advancing the counter or other tracking towards the threshold where some additional benefit becomes available to the player.

The foregoing description of the representative embodiments has been presented for the purposes of illustration and description. It is not intended to be exhaustive or to limit the invention to the precise form disclosed. Many modifications and variations are possible in light of the above teaching. For example, the present invention is equally applicable in electronic or mechanical gaming machines, and is also applicable to live table versions of gaming activities that are capable of being played in a table version (e.g., machines involving poker or card games that could be played via table games).

Some embodiments have been described above, and in addition, some specific details are shown for purposes of illustrating the inventive principles. However, numerous other arrangements may be devised in accordance with the inventive principles of this patent disclosure. Further, well known processes have not been described in detail in order not to obscure the invention. Thus, while the invention is described in conjunction with the specific embodiments illustrated in the drawings, it is not limited to these embodiments or drawings. Rather, the invention is intended to cover alternatives, modifications, and equivalents that come within the scope and spirit of the inventive principles set out above.

What is claimed is:

1. A gaming apparatus utilizing symbols to identify winning results, comprising:

a symbol selection module configured to select symbols for a slot game event;

a display to present the selected symbols in a play area of the slot game event, and to display correlations of designated ones of the selected symbols and respective tracking values;

a tracking module coupled to the symbol selection module to maintain the tracking values for each of the designated symbols, and to advance each of the tracking values towards a threshold value in response to its respective one of the designated symbols being involved in a winning symbol combination;

a monitor module coupled to the tracking module to determine that any of the tracking values reach the threshold value;

an award enhancement module coupled to the monitor module to award a payout enhancement for the winning symbol combinations associated with the designated symbols involved in the winning symbol combinations, in response to the tracking module determining that any of the tracking values reached the threshold value; and an award identification module to award payouts from the winning symbol combinations, and to enhance the identified payouts with the payout enhancement for those winning symbol combinations that were awarded the payout enhancement.

2. The gaming apparatus of claim 1, wherein the tracking values comprise counter values each having an initial count, the threshold value comprises a counter threshold value, and wherein the tracking module comprises a counter module configured to reset the counter values to the initial count in response to the determining that any of the respective counter values reached the counter threshold value.

3. The gaming apparatus of claim 1, wherein:

the tracking values comprise counter values each beginning at a respective initial count;

the threshold values each comprise counter threshold values corresponding to respective ones of the count values in which the payout enhancement for the respective designated selected symbols will be awarded; and the tracking module comprises a counter module configured to maintain a current count value for each of the designated ones of the selected symbols, and to advance the counter towards the counter threshold values.

4. The gaming apparatus of claim 3, wherein the monitor module comprises one or more comparator modules configured to determine that any of the counter values reach the respective counter threshold values.

5. The gaming apparatus of claim 4, wherein the award enhancement module is coupled to the counter module and is configured to award the payout enhancement for the winning symbol combinations associated with the designated symbols involved in the winning symbol combinations, in response to the one or more comparator modules determining that any of the counter values reached the respective counter threshold value.

6. The gaming apparatus of claim 3, wherein the initial count is common to each of the designated symbols, and wherein the counter threshold values are common to each of the designated symbols.

7. The gaming apparatus of claim 1, wherein:

the payout enhancement comprises a multiplier value;

the award enhancement module is configured to award the multiplier value for the winning symbol combinations associated with the designated symbols involved in the winning symbol combinations, in response to the tracking module determining that any of the tracking values reached the threshold value; and the award identification module is configured to enhance the identified payouts with the multiplier value for those winning symbol combinations that were awarded the payout enhancement, by multiplying the respective identified payouts and the multiplier value.

8. The gaming apparatus of claim 7, wherein the multiplier value is the same for each of the winning symbol combinations.

9. The gaming apparatus of claim 7, wherein a plurality of the multiplier values are provided, and respectively associated with different ones or more of the winning symbol combinations.

10. The gaming apparatus of claim 1, wherein the tracking module is configured to advance each of the tracking values towards a threshold value in response to its respective one of the designated symbols being involved in a winning symbol combination in a particular quantity.

11. A slot game apparatus for enhancing gaming awards in a slot game, comprising:

a display presenting a plurality of symbols in symbol locations forming a symbol array, and presenting correlations of specified ones of the symbols and respective counter values;

a user interface including at least one user input to enable a player to initiate a slot game event presented via the symbol array;

a wager input device structured to identify and validate player assets, and to permit the player to play the slot game event when the player assets are provided; and a processor configured to:

randomly select some of the plurality of symbols for positioning in the symbol locations of the symbol array in response to initiating of a slot game event;

advance the counter values associated with each of the specified symbols if the respective specified symbol is involved in a result of the slot game event involving a payout;

monitor for any of the counter values reaching a threshold;

for any of the counter values reaching the threshold, award a respective payout modifier; and increase the payout of the slot game events whose counter values have reached the threshold by mathematically applying its respective payout modifier thereto.

12. The slot game apparatus of claim 11, wherein the processor is configured to cause the display to present updates to the correlations of specified ones of the symbols and their respective counter values as additional ones of the specified symbols are involved in results of the slot game events involving the payouts.

13. The slot game apparatus of claim 11, wherein the payout modifier comprises a multiplier value determined in advance of the initiation of the slot game event and made known to the player.

14. The slot game apparatus of claim 11, wherein the processor is configured to advance the counter values a single advance for each of the specified symbols involved in the result of the slot game event involving a payout, regardless of the quantity of results involving the payouts originating from the same one of the specified symbols.

15. The slot game apparatus of claim 11, wherein the processor is configured to advance the counter values once for each of the quantity of results involving the payouts originating from the same one of the specified symbols.

16. The slot game apparatus of claim 11, wherein the processor is configured to advance the counter values associated with each of the specified symbols if the respective specified symbol is involved in the result involving a payout, and if the result involving the respective specified symbol has a predetermined minimum number of consecutive ones of the specified symbols.

17. The slot game apparatus of claim 11, wherein the processor is configured to advance the counter values associated with each of the specified symbols if the respective specified symbol is involved in the result involving a payout, and if an indicator is presented in connection with the slot game event that enables the advancement.

18. The slot game apparatus of claim 11, wherein the display further presents separate correlations of the respective counter values for each of the specified ones of the symbols based on their consecutive symbol length.

* * * * *